US006687471B2

(12) United States Patent
Sakata et al.

(10) Patent No.: US 6,687,471 B2
(45) Date of Patent: Feb. 3, 2004

(54) IMAGE FORMING APPARATUS

(75) Inventors: Satoshi Sakata, Hino (JP); Akira Okamoto, Hino (JP); Hideo Yamane, Hino (JP); Kenji Kato, Hachioji (JP)

(73) Assignee: Konica Corporation, Tokyo (JP)

( * ) Notice: Subject to any disclaimer, the term of this patent is extended or adjusted under 35 U.S.C. 154(b) by 2 days.

(21) Appl. No.: 10/208,380

(22) Filed: Jul. 29, 2002

(65) Prior Publication Data

US 2003/0026624 A1 Feb. 6, 2003

(30) Foreign Application Priority Data

Aug. 3, 2001 (JP) ..... 2001-236176

(51) Int. Cl.[7] ..... G03G 15/00

(52) U.S. Cl. ..... 399/49; 399/72

(58) Field of Search ..... 399/38, 46, 49, 399/72, 81

(56) References Cited

U.S. PATENT DOCUMENTS 6,337,958 B1 * 1/2002 Stanich et al. ..... 399/49
6,418,281 B1 * 7/2002 Ohki ..... 399/49

* cited by examiner

*Primary Examiner*—Hoan Tran
(74) *Attorney, Agent, or Firm*—Squire Sanders & Dempsey

(57) ABSTRACT

There is described an image-forming apparatus for forming a toner image on a recording medium, a size of which is larger than that of the toner image being a fixed form size, based on image data corresponding to the fixed form size. The image-forming apparatus includes an image-forming section to form the toner image in a region of the fixed form size, based on the image data corresponding to the fixed form size, and to form a specific toner image in a specific region outside the fixed form size, both the region and the specific region being shared each other within a whole area of the recording medium; and a controlling section to control the image-forming section so as to form a predetermined patch image, serving as the specific toner image, in the specific region outside the fixed form size.

25 Claims, 8 Drawing Sheets

DOUBLE FEEDING PATCH

MARKER FOR DOUBLE FEEDING CHECK

MARKER FOR CHAPTER CHECK (THE FIRST CHAPTER)

MARKER FOR CHAPTER CHECK (THE SECOND CHAPTER)

MARKER FOR CHAPTER CHECK (THE THIRD CHAPTER)

IMAGE CONTROL FLOWCHART

TIMING CONTROL FLOWCHART

MARKER FOR COPY CHECK (THE FIRST COPY)

MARKER FOR COPY CHECK (THE SECOND COPY)

MARKER FOR COPY CHECK (THE THIRD COPY)

MARKER FOR PAGE CHECK (THE FIRST PAGE)

MARKER FOR PAGE CHECK (THE SECOND PAGE)

MARKER FOR PAGE CHECK (THE THIRD PAGE)

IMAGE FORMING APPARATUS

BACKGROUND OF THE INVENTION

The present invention relates to an image forming apparatus, and particularly to an image forming apparatus by which a toner image corresponding to an image data of a fixed form size is formed on a recording sheet whose size is larger than the fixed form size, and outputted.

The image forming apparatus by which a toner image corresponding to an image data of a fixed form size is formed on a recording sheet (wide sheet) whose size is larger than the fixed form size, and outputted, exists. In this connection, in this case, it is presupposed that, in the wide sheet in which the image is formed in an area of the fixed form size, an unnecessary margin portion is cut, and the sheet is made the fixed form size on which the image is formed.

In the case of the image formation on the wide sheet, even when a stamp function or overlay function are combinedly used, in the area of the fixed form size, the stamp image or overlay image is formed. That is, it is in a condition that, because there is no necessity until now, the function to form the image in the margin portion of the wide sheet is not provided, and no image is formed in the margin portion.

For the recording sheet outputted by the image formation, a check called double feeding check is necessary. In the case of the double feeding check, it is necessary that the recording sheets are turned over manually one by one sheet carefully, and the existence or not of the image is checked. Or, it is necessary that the double feeding detection sensor is provided in the image forming apparatus in order not to use a hand, resulting in cost up of the apparatus.

Further, not only the double feeding check, when a plurality of copies of the image formation is conducted by making a plurality of pages or chapters as unit, the same problem is also generated for the check of the image of each page, each chapter, or each copy.

In this connection, in order to make clear the image of the each page, each chapter or each copy, a classifying apparatus which is called finisher is mounted onto the image forming apparatus. In this finisher, in order to classify the each page, each chapter or each copy, it is coped with the problem in such a manner that a delivery position of the recording sheet is changed, or the recording sheet is shifted for each delivery. However, even when the classification is thus made, when the margin portion of the wide sheet is cut, it is necessary that the classified recording sheets are completed again, and it is troublesome.

Further, in order to detect that the desired density is stably formed on the image, a patch image is formed on the photoreceptor surface and the patch image is detected by a sensor. However in this method, because the density is detected by the patch image on the photoreceptor before the transfer, not on the recording sheet on which actually the image is formed, it has a problem that there is a case where it becomes the detection result different from the actual result.

SUMMARY OF THE INVENTION

To overcome the abovementioned drawbacks in conventional image forming apparatus, it is an object of the present invention to provide an image forming apparatus by which each kind of check can be conducted by using a margin portion of the recording sheet which is finally cut, when a toner image corresponding to the fixed form size image data is formed on a recording sheet whose size is larger than the fixed form size, and outputted.

Accordingly, to overcome the cited shortcomings, the abovementioned object of the present invention can be attained by image forming apparatus described as follow.

(1) An apparatus for forming a toner image on a recording medium, a size of which is larger than that of the toner image being a fixed form size, based on image data corresponding to the fixed form size, the apparatus comprising: an image-forming section to form the toner image in a region of the fixed form size, based on the image data corresponding to the fixed form size, and to form a specific toner image in a specific region outside the fixed form size, both the region and the specific region being shared each other within a whole area of the recording medium; and a controlling section to control the image-forming section so as to form a predetermined patch image, serving as the specific toner image, in the specific region outside the fixed form size.

(2) The apparatus of item 1, wherein the controlling section controls the image-forming section so that a whole area of the predetermined patch image is contained within the specific region of the recording medium and so that the predetermined patch image is formed at a same position of each of a plurality of recording mediums, each of which is the recording medium.

(3) The apparatus of item 1, wherein the apparatus also has a duplex image forming capability for forming an obverse image and a reverse image on both sides of the recording medium; and wherein the controlling section controls the image-forming section so that an image-forming region of the obverse image coincides with that of the reverse image on both sides of the recording medium in order to cutout the specific region outside the fixed form size at three positions including a top position, a bottom position and a longitudinal position.

(4) The apparatus of item 1, further comprising: a density detecting sensor to detect a density of the predetermined patch image; wherein the controlling section controls a density of toner employed for a developing operation, a developing bias voltage and/or a charged voltage employed for a transferring operation, in response to the density of the predetermined patch image detected by the density detecting sensor.

(5) The apparatus of item 1, further comprising: an operational command inputting device to input an operational command for setting a position of the predetermined patch image; wherein the controlling section controls the image-forming section so that the predetermined patch image is formed at the position, determined by the operational command inputted from the operational command inputting device, located within the specific region, serving as a margin space of the recording medium.

(6) The apparatus of item 5, wherein the apparatus also has a duplex image forming capability for forming an obverse image and a reverse image on an obverse side and a reverse side of the recording medium, respectively; and wherein the controlling section controls the image-forming section so that the predetermined patch image is independently formed on each of the obverse side and the reverse side of the recording medium.

(7) The apparatus of item 1, further comprising: an operational command inputting device to input a first operational command for initially setting a position of the predetermined patch image and a second operational command for finely adjusting the position of the predetermined patch image thereafter; and a display device to display a position setting diagram for finely adjusting the position of the predetermined patch image; wherein the controlling section controls the image-forming section and the display device so that the position setting diagram for finely adjusting the position of the predetermined patch image is displayed on the display device after forming the predetermined patch image at a first position initially determined by the first operational command inputted from the operational command inputting device, and then, the predetermined patch image is formed at a second position finely adjusted by the second operational command inputted from the operational command inputting device based on contents of the position setting diagram.

(8) The apparatus of item 1, wherein, when the apparatus forms toner images on a plurality of recording mediums, which include a plurality of chapters and each of which is the recording medium, the controlling section controls the image-forming section so that the predetermined patch image is formed at a same position on each of recording mediums, which are included in the plurality of recording mediums and constitutes one of the plurality of chapters.

(9) The apparatus of item 8, wherein the controlling section controls the image-forming section so that a position of the predetermined patch image formed on each of the plurality of recording mediums varies with changes of the plurality of chapters.

(10) The apparatus of item 9, further comprising: an operational command inputting device to input an operational command for setting a position of the predetermined patch image; wherein the controlling section controls the image-forming section so that the predetermined patch image is formed at the position, determined by the operational command inputted from the operational command inputting device, located within the specific region serving as a margin space of the recording medium.

(11) The apparatus of item 8, wherein the apparatus also has a duplex image forming capability for forming an obverse image and a reverse image on both sides of the recording medium; and wherein the controlling section controls the image-forming section so that an image-forming region of the obverse image coincides with that of the reverse image on both sides of the recording medium in order to cutout the specific region outside the fixed form size at three positions including a top position, a bottom position and a longitudinal position, and so that the predetermined patch image is formed at a position located within the specific region serving as a margin space of the recording medium.

(12) The apparatus of item 10, wherein the apparatus also has a duplex image forming capability for forming an obverse image and a reverse image on an obverse side and a reverse side of the recording medium, respectively; and wherein the controlling section controls the image-forming section so that the predetermined patch image is independently formed on each of the obverse side and the reverse side of the recording medium.

(13) The apparatus of item 8, further comprising: an operational command inputting device to input a first operational command for initially setting a position of the predetermined patch image and a second operational command for finely adjusting the position of the predetermined patch image thereafter; and a display device to display a position setting diagram for finely adjusting the position of the predetermined patch image; wherein the controlling section controls the image-forming section and the display device so that the position setting diagram for finely adjusting the position of the predetermined patch image is displayed on the display device after forming the predetermined patch image at a first position initially determined by the first operational command inputted from the operational command inputting device, and then, the predetermined patch image is formed at a second position finely adjusted by the second operational command inputted from the operational command inputting device based on contents of the position setting diagram.

(14) The apparatus of item 1, wherein, when the apparatus produces a plurality of copies, each of which includes a plurality of recording mediums each of which is the recording medium having the toner image formed by the image-forming section, the controlling section controls the image-forming section so that the predetermined patch image is formed at a same position on each of the plurality of recording mediums constituting one of the plurality of copies.

(15) The apparatus of item 14, wherein the controlling section controls the image-forming section so that a position of the predetermined patch image formed on each of the plurality of recording mediums varies with changes of the plurality of copies.

(16) The apparatus of item 15, further comprising: an operational command inputting device to input an operational command for setting a position of the predetermined patch image; wherein the controlling section controls the image-forming section so that the predetermined patch image is formed at the position, determined by the operational command inputted from the operational command inputting device, located within the specific region serving as a margin space of the recording medium.

(17) The apparatus of item 14, wherein the apparatus also has a duplex image forming capability for forming an obverse image and a reverse image on both sides of the recording medium; and wherein the controlling section controls the image-forming section so that an image-forming region of the obverse image coincides with that of the reverse image on both sides of the recording medium in order to cutout the specific region outside the fixed form size at three positions including a top position, a bottom position and a longitudinal position, and so that the predetermined patch image is formed at a position located within the specific region serving as a margin space of the recording medium.

(18) The apparatus of item 16, wherein the apparatus also has a duplex image forming capability for forming an obverse image and a reverse image on an obverse side and a reverse side of the recording medium, respectively; and wherein the controlling section controls the image-forming section so that the predetermined patch image is independently formed on each of the obverse side and the reverse side of the recording medium.

(19) The apparatus of item 14, further comprising: an operational command inputting device to input a first operational command for initially setting a position of the predetermined patch image and a second operational command for finely adjusting the position of the predetermined patch image thereafter; and a display device to display a position setting diagram for finely adjusting the position of the predetermined patch image; wherein the controlling section controls the image-forming section and the display device so that the position setting diagram for finely adjusting the position of the predetermined patch image is displayed on the display device after forming the predetermined patch image at a first position initially determined by the first operational command inputted from the operational command inputting device, and then, the predetermined patch image is formed at a second position finely adjusted by the second operational command inputted from the operational command inputting device based on contents of the position setting diagram.

(20) The apparatus of item 1, wherein, when the apparatus produces a plurality of copies, each of which includes a plurality of recording mediums each of which is the recording medium having the toner image formed by the image-forming section and onto which a plurality of page numbers are attached one by one, the controlling section controls the image-forming section so that the predetermined patch image is formed at a same position on each of recording mediums having a same page number and included in the plurality of copies.

(21) The apparatus of item 20, wherein the controlling section controls the image-forming section so that a position of the predetermined patch image formed on each of the plurality of recording mediums varies with changes of the plurality of page numbers.

(22) The apparatus of item 21, further comprising: an operational command inputting device to input an operational command for setting a position of the predetermined patch image; wherein the controlling section controls the image-forming section so that the predetermined patch image is formed at the position, determined by the operational command inputted from the operational command inputting device, located within the specific region serving as a margin space of the recording medium.

(23) The apparatus of item 20, wherein the apparatus also has a duplex image forming capability for forming an obverse image and a reverse image on both sides of the recording medium; and wherein the controlling section controls the image-forming section so that an image-forming region of the obverse image coincides with that of the reverse image on both sides of the recording medium in order to cutout the specific region outside the fixed form size at three positions including a top position, a bottom position and a longitudinal position, and so that the predetermined patch image is formed at a position located within the specific region serving as a margin space of the recording medium.

(24) The apparatus of item 22, wherein the apparatus also has a duplex image forming capability for forming an obverse image and a reverse image on an obverse side and a reverse side of the recording medium, respectively; and wherein the controlling section controls the image-forming section so that the predetermined patch image is independently formed on each of the obverse side and the reverse side of the recording medium.

(25) The apparatus of item 20, further comprising: an operational command inputting device to input a first operational command for initially setting a position of the predetermined patch image and a second operational command for finely adjusting the position of the predetermined patch image thereafter; and a display device to display a position setting diagram for finely adjusting the position of the predetermined patch image; wherein the controlling section controls the image-forming section and the display device so that the position setting diagram for finely adjusting the position of the predetermined patch image is displayed on the display device after forming the predetermined patch image at a first position initially determined by the first operational command inputted from the operational command inputting device, and then, the predetermined patch image is formed at a second position finely adjusted by the second operational command inputted from the operational command inputting device based on contents of the position setting diagram.

Further, to overcome the abovementioned problems, other image forming apparatus, embodied in the present invention, will be described as follow:

(26) An image forming apparatus in which a toner image corresponding to the fixed form size image data is formed on a recording sheet whose size is larger than the fixed form size, and outputted, the image forming apparatus is characterized in that: an image recording means by which the toner image corresponding to the fixed form size image data is formed in an area of the fixed form size of the recording sheet, and also in an outside of an area of the fixed form size of the recording sheet, the toner image can be formed; and a control means for controlling so that a predetermined patch image is formed onto the outside of the area of the fixed form size of the recording sheet by the recording means, are provided.

In this invention, when the toner image corresponding to the fixed form sized image data is formed on the recording sheet whose size is larger than the fixed form size and outputted, the toner image corresponding to the fixed form sized image data is formed in the area of the fixed form size of the recording sheet, and it is made in such a manner that, also in the outside of an area of the fixed form size of the recording sheet (margin portion to be cut), toner image can be formed, and controlled so that a predetermined patch image is formed on the margin portion.

Then, when the patch image in this margin portion is detected by a sensor, it can be used for the double feeding check, or also for the check of the image of each page, each chapter, each copy when the image formation of a plurality of copies is conducted by making the recording sheet of a plurality of pages or a plurality of chapters a unit. Accordingly, when they are checked, it is not necessary that the recording sheet is manually turned over one by one sheet carefully and the existence or not of the image is checked, or an exclusive use sensor is provided.

Further, in order to detect that the desired density is stably formed on the image, when the patch image in the margin portion of the recording sheet, not the patch image on the photoreceptor surface, is detected by a sensor, the density of the image actually formed on the recording sheet can be checked.

As the result, when the toner image corresponding to the fixed form sized image data is formed on the recording sheet whose size is larger than the fixed form size and outputted, by using the margin portion of the recording sheet which is finally cut, each kind of check can be conducted.

(27) An image forming apparatus according to (26), wherein the control means forms a predetermined patch image so that it has the dimension within the range which can be accommodated in the outside of an area of the fixed form size, and controls so that it is formed at the same position on a plurality of recording sheets.

In this invention, in (26), the predetermined patch image is formed so as to have the dimension within the range which can be accommodated in the outside of the fixed form size area, and it is controlled so that the patch image is formed at the same position on a plurality of recording sheets.

According to this, the double feeding of the recording sheet can be simply and surely detected according to the existence or not of this patch image. Further, because a check of only the sheet end portion is allowed, there is no influence on the formed image.

(28) An image forming apparatus according to either one of (26) or (27), wherein, when the double side image formation of the recording sheet is conducted, the control means controls so that the image is formed in the area in which the image formation area of the front surface of the recording sheet coincides with the image formation area of the rear surface, in order that the portion of the outside of the area of the fixed form size may be cut in the 3 directions of the recording sheet, and controls so that the patch image is formed in the margin of the recording sheet.

In this invention, in (26) or (27), when the double side image formation of the recording sheet is conducted, the control means controls so that the image is formed in the area in which the image formation area of the front surface of the recording sheet coincides with the image formation area of the rear surface, in order that the portion (margin portion) of the outside of the area of the fixed form size may be cut in the 3 directions of the recording sheet, and the patch image is formed in the margin of the recording sheet.

In this manner, when the image is formed in the area in which the image formation area of the front surface of the recording sheet coincides with the image formation area of the rear surface, and the patch image is formed in the margin of the recording sheet, the checks in (26) and (27) are conducted, and the margin portion can be cut in the 3 directions of the recording sheet.

(29) An image forming apparatus according to any one of (26) to (28), wherein it has a density sensor to detect the density of the patch image, and the control means, corresponding to the density of the patch image detected by the density sensor, controls the density of the toner used for the development or developing bias voltage, or charging voltage used for the transfer.

In this invention, in (26)–(28), corresponding to the density of the patch image, the density of the toner used for the development or the developing bias voltage, or the charging voltage used for the transfer is controlled.

In this manner, when the patch image in a predetermined portion in the margin portion of the recording sheet is detected by the sensor, the density of the image actually formed on the recording sheet can be surely checked, and it can be controlled so that the desired density is stably formed on the image.

(30) An image forming apparatus according to any one of (26) to (29), wherein it has an operation input means for conducting the setting of the position of the patch image, and the control means, corresponding to the position set by the operation input means, controls so that the patch image is formed in the margin of the recording sheet.

In this invention, in (26)–(29), it is controlled so that the patch image is formed in the margin of the recording sheet corresponding to the position set by the operation input means. That is, considering the shape or dimension of the margin portion of the recording sheet, or easiness of the checking of the patch image, or relationship with the image in the image formation area, when the user selects the appropriate position, the check can be surely conducted.

(31) An image forming apparatus according to any one of (26) to (29), wherein it has the operation input means for conducting the setting of the position of the patch image, and the control means, corresponding to the position set by the operation input means, conducts the control to form the patch image in the margin of the recording sheet independently in each of the front and rear of the recording sheet.

In this invention, in (26)–(29), corresponding to the position set by the operation input means, the control by which the patch image is formed in the margin of the recording sheet, is independently conducted in each of the front and rear of the recording sheet.

That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered at the front and rear, and the check can be surely conducted in each of the front and rear of the recording sheet.

(32) An image forming apparatus according to any one of (26) to (31), wherein it has a display means and operation input means for conducting the initial setting of the position of the patch image and resetting, and the control means controls so that it displays the position resetting image plane for conducting the fine adjustment of the position of the patch image on the display means after the patch image is formed corresponding to the initially set position, and according to the inputted value into the operation input means according to the position resetting image plane, the patch image is formed in the margin of the recording sheet.

In this invention, in (26)–(31), it is controlled so that, after the patch image is formed corresponding to the initially set position, the position resetting image plane for conducting the fine adjustment of the position of the patch image is displayed on the display means, and according to the value inputted into the operation input means according to the position resetting image plane, the patch image is formed in the margin of the recording sheet.

That is, considering the shape or dimension of the margin portion of the recording sheet, or easiness of the checking of the patch image, or relationship with the image in the image formation area, when the user resets the appropriate position referring to the output of the recording sheet, the telescopic motion of the recording sheet by the fixing, or the slippage of the reading timing is dissolved, and the check can be more surely conducted.

(33) An image forming apparatus in which the toner image corresponding to the fixed form size image data is formed on the recording sheet whose size is larger than the fixed form size and outputted, the image forming apparatus is characterized in that: it has an image recording means by which the toner image corresponding to the fixed form size image data is formed in the fixed form size area of the recording sheet, and the formation of the toner image can be conducted also in the outside of the fixed form size area of the recording sheet; and a control means which controls so that a predetermined patch image is formed in the outside of the fixed form size area of the recording sheet, and the control means conducts the control by which the patch image is attached to the same position for a plurality of recording sheets constituting the same chapter, when the image formation of a plurality of chapters is conducted on the plurality of recording sheets.

In this invention, when the toner image corresponding to the fixed firm size image data is formed on the recording sheet whose size is larger than the fixed form size, and outputted, the toner image corresponding to the fixed form size image data is formed in the fixed form size area of the recording sheet, and it is made in such a manner that the toner image can be formed also in the outside of the fixed form size area (margin portion to be cut) of the recording sheet, and when the image formation of the plurality of chapters is conducted on the plurality of recording sheets, the predetermined patch image is formed in the margin portion, and the control by which the patch image is attached to the same position for the plurality of recording sheets constituting the same chapter, is conducted. That is, at the time point when the chapter is changed, the control by which the position of the patch image is changed, is conducted.

Then, when the patch image of the margin portion is detected by the sensor, it can be used for the check of the images of each chapter when the image formation of the plurality of copies is conducted by making the recording sheets of the plurality of pages or plurality of chapters a unit. Accordingly, at the time of the check, it becomes not necessary that the recording sheets are manually turned over one by one sheet carefully and the existence or not of the image is checked, or exclusive use sensor is provided.

As the result, when the toner image corresponding to the image data of the fixed form size is formed on the recording sheet whose size is larger than the fixed form size, and outputted, by using the margin portion of the recording sheet which is finally cut, the check for each chapter at the time of bookbinding can be conducted.

(34) An image forming apparatus according to (33), wherein, when the image formation of the plurality of chapters is conducted on the plurality of recording sheets, the control means controls that the patch image is attached to the same position for the plurality of recording sheets constituting the same chapter, and when the chapter of the plurality of recording sheets is different, controls that the patch image is attached to the different positions.

In this invention, in (33), when the image formation of the plurality of chapters is conducted on the plurality of recording sheets, it is controlled that the patch image is attached to the same position for the plurality of recording sheets constituting the same chapter, and when the chapter of the plurality of recording sheets is different, the patch image is attached to the different positions.

As the result, when the toner image corresponding to the fixed form size image data is formed on the recording sheet whose size is larger than the fixed form size and outputted, by using the margin portion of the recording sheet which is finally cut, the check for each chapter for the plurality of chapters at the time of bookbinding, can be conducted.

(35) An image forming apparatus according to (33), wherein it has an operation input means for conducting the setting of the position of the patch image, and when the image formation of the plurality of chapters is conducted on the plurality of the recording sheets, the control means controls that the patch image is attached to the same position for the plurality of recording sheets constituting the same chapter, and when the chapter of the plurality of the recording sheets is different, the patch image is attached to the different position according to the setting value set by the operation input means.

In this invention, in (33), when the image formation of the plurality of chapters is conducted on the plurality of recording sheets, the control by which the patch image is attached to the same position for the plurality of recording sheets constituting the same chapter, is conducted, and when the chapter of the plurality of the recording sheets is different, the control by which the patch image is attached to the different position according to the setting value for the change distance in the set main scanning direction or sub scanning direction, is conducted.

In this result, when the toner image corresponding to the fixed form size image data is formed on the recording sheet whose size is larger than the fixed form size, and outputted, by using the margin portion of the recording sheet which is finally cut, the check for each chapter for the plurality of chapters at the time of bookbinding can be surely conducted.

(36) An image forming apparatus according to any one of (33) to (35), wherein, when the double side image formation of the recording sheet is conducted, the control means controls the image formation such that the image formation areas of the front and rear of the recording sheet coincide with each other so that a portion of the outside of the area of the fixed form size can be cut in 3 directions of the recording sheet, and controls such that the patch image is formed in the margin of the recording sheet.

In this invention, in (33)–(35), when the double side image formation of the recording sheet is conducted, the image formation is controlled such that the image formation areas of the front and rear of the recording sheet coincide with each other so that the 3 direction cutting can be conducted.

When the image is formed so that the image formation areas of the front and rear of the recording sheet coincide with each other, the image formation area of the front surface of the recording sheet coincides with the patch image position of the rear surface, and the check is conducted, and the margin portion can be cut in the 3 direction of the recording sheet.

(37) An image forming apparatus according to (11), wherein it has the operation input means for setting the position of the patch image, and the control means conducts the control to form the patch image in the margin of the recording sheet corresponding to the position set by the operation input means independently in each of the front and rear of the recording sheet.

In this invention, in (36), corresponding to the position set by the operation input means, the control by which the patch image is formed in the margin of the recording sheet is independently conducted in each of the front and rear of the recording sheet.

That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered in the front and rear, and the check can be surely conducted in each of the front and rear of the recording sheet.

(38) An image forming apparatus according to any one of (33) to (37), wherein it has a display means and operation input means for conducting the initial setting and resetting of the position of the patch image, and the control means, after the patch image is formed corresponding to the initially set position, controls so that the position resetting image plane for conducting the fine adjustment of the position of the patch image is displayed on the display means, and according to the value inputted into the operation input means according to the position resetting image plane, the patch image is formed in the margin of the recording sheet.

In this invention, in (33)–(37), after the patch image is formed corresponding to the initially set position, the position resetting image plane for conducting the fine adjustment of the position of the patch image is displayed on the display means, and according to the value inputted into the operation input means according to the position resetting image plane, the control means controls so that the patch image is formed in the margin of the recording sheet.

That is, considering the shape or dimension of the margin portion of the recording sheet, or easiness of the checking of the patch image, or relationship with the image in the image formation area, when the user resets the appropriate position referring to the output of the recording sheet, the telescopic motion of the recording sheet by the fixing, or the slippage of the reading timing is dissolved, and the check can be surely conducted.

(14) An image forming apparatus in which the toner image corresponding to the fixed form size image data is formed on the recording sheet whose size is larger than the fixed form size, and outputted, the image forming apparatus is characterized in that: it has an image recording means by which the toner image corresponding to the fixed form size image data is formed in the area of the fixed form size of the recording sheet, and in also the outside of the area of the fixed form size of the recording sheet, the toner image can be formed; and a control means which controls so that a predetermined patch image is formed in the outside of the area of the fixed form size of the recording sheet by the recording means, and the control means conducts the control by which the patch image is attached to the same position for a plurality of recording sheets constituting the same copy, when the image formation of a plurality of copies is conducted by making the plurality of recording sheets a unit.

In this invention, when the toner image corresponding to the fixed form size image data is formed on the recording sheet whose size is larger than the fixed form size, and outputted, it is made so that the toner image corresponding to the fixed form size image data is formed in the area of the fixed form size of the recording sheet, and in also the outside of the area (margin portion to be cut) of the fixed form size of the recording sheet, the toner image can be formed, and the control by which, when the image formation of a plurality of copies is conducted by making the plurality of recording sheets a unit, the patch image is attached to the same position for a plurality of recording sheets constituting the same copy, is conducted. That is, at the time point when the copy is changed, the control by which the position of the patch image is changed, is conducted.

Then, when the patch image in the margin portion is detected by the sensor, it can be used for the check of the image for the same copy when the image formation of a plurality of copies is conducted by making the recording sheets of the plurality of copies a unit. Accordingly, at the time of this check, it becomes no necessary that the recording sheets are manually turned over carefully one by one sheet and the existence or not of the image is checked, or an exclusive use sensor is provided.

As the result, when the toner image corresponding to the fixed form size image data is formed on the recording sheet whose size is larger than the fixed form size, and outputted, by using the margin portion of the recording sheet which is finally cut, the check for each copy at the time of bookbinding can be conducted.

(40) An image forming apparatus according to (39), wherein, when, by making a plurality of recording sheets a unit, the image formation of the plurality of copies is conducted, the control by which the patch image is attached to the same position for the plurality of recording sheets constituting the same copy, and when the copy is different, the patch image is attached to the different position, is conducted.

In this invention, in (39), when the image formation of a plurality of copies is conducted by making a plurality of recording sheets a unit, the control by which the patch image is attached to the same position for the plurality of recording sheets constituting the same copy, is conducted, and the control by which the patch image is attached to the different position when the copy is different, is conducted.

As the result, when the toner image corresponding to the fixed form size image data is formed on the recording sheet whose size is larger than the fixed form size, and outputted, by using the margin portion of the recording sheet which is finally cut, the check for each copy of the plurality of copies at the time of bookbinding can be conducted.

(41) An image forming apparatus according to (14), wherein, when the image formation of a plurality of copies is conducted by making a plurality of recording sheets a unit, the control by which the patch image is attached to the same position for the plurality of recording sheets constituting the same copy, is conducted, and when the copy is different, the control by which the patch image is attached to the different position according to the setting value set by the operation input means, is conducted.

In this invention, in (39), when the image formation of a plurality of copies is conducted by making a plurality of recording sheets a unit, the control by which the patch image is attached to the same position for the plurality of recording sheets constituting the same copy, is conducted, and when the copy is different, the control by which the patch image is attached to the different position according to the setting value for the changed distance in the main scanning direction or sub scanning direction set by the operation input means, is conducted.

As the result, when the toner image corresponding to the fixed form size image data is formed on the recording sheet whose size is larger than the fixed form size, and outputted, by using the margin portion of the recording sheet which is finally cut, the check for each copy of the plurality of copies at the time of bookbinding can be surely conducted.

(42) An image forming apparatus according to any one of (39) to (41), wherein, when the double side image formation of the recording sheet is conducted, the control means conducts the control of the image formation such that the image formation areas of the front and rear of the recording sheet coincide with each other so that the portion outside the fixed form size area can be cut in 3 directions of the recording sheet, and controls so that the patch image is formed in the margin of the recording sheet.

In this invention, in (39)–(41), when the double side image formation of the recording sheet is conducted, the control of the image formation is conducted so that the image formation areas of the front and rear of the recording sheet coincide with each other so as to be able to be cut in the 3 directions.

In this manner, when the image formation is conducted so that the image formation areas of the front and rear of the recording sheet coincide with each other, the image formation area of the front surface of the recording sheet coincides with the patch image position of the rear surface, and when the above check is conducted, the margin portion can be cut in 3 directions of the recording sheet.

(43) An image forming apparatus according to (42), wherein it has an operation input means for conducting the setting of the position of the patch image, and the control means conducts the control by which the patch image is formed in the margin of the recording sheet corresponding to the position set by the operation input means, independently on each of the front and rear surface of the recording sheet.

In this invention, in (42), corresponding to the position set by the operation input means, the control by which the patch image is formed in the margin of the recording sheet, is independently conducted on each of the front and rear surface of the recording sheet.

That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered on the front and rear, and the check can be surely conducted on each of the front and rear surface of the recording sheet.

(44) An image forming apparatus according to any one of (39) to (43), wherein it has an display means and operation input means for conducting the initial setting and resetting of the position of the patch image, and the control means controls so that the position resetting image plane for conducting the fine adjustment of the position of the patch image is displayed on the display means, after the patch image is formed corresponding to the position which is set initially, and according to the value inputted into the operation input means according to the position resetting image plane, so that the patch image is formed in the margin of the recording sheet.

In this invention, in (39)–(43), after the patch image is formed corresponding to the initially set position, the position resetting image plane for conducting the fine adjustment of the position of the patch image is displayed on the display means, and according to the value inputted into the operation input means according to the position resetting image plane, the control means controls so that the patch image is formed in the margin of the recording sheet.

That is, considering the shape or dimension of the margin portion of the recording sheet, or easiness of the checking of the patch image, or relationship with the image in the image formation area, when the user resets the appropriate position referring to the output of the recording sheet, the telescopic motion of the recording sheet by the fixing, or the slippage of the reading timing is dissolved, and the check can be surely conducted.

(45) An image forming apparatus in which the toner image corresponding to the fixed form size image data is formed on the recording sheet whose size is larger than the fixed form size, and outputted, the image forming apparatus is characterized in that: it has an image recording means by which the toner image corresponding to the fixed form size image data is formed in the area of the fixed form size of the recording sheet, and in also the outside of the area of the fixed form size, the toner image can be formed; and a control means which controls so that a predetermined patch image is formed in the outside of the area of the fixed form size of the recording sheet by the recording means, and the control means conducts the control by which the patch image is attached to the same position for a plurality of recording sheets constituting the same page, when the image formation of a plurality of copies is conducted by making the plurality of recording sheets a unit.

In this invention, when the toner image corresponding to the fixed form size image data is formed on the recording sheet whose size is larger than the fixed form size, and outputted, it is made so that the toner image corresponding to the fixed form size image data is formed in the area of the fixed form size of the recording sheet, and in also the outside of the area (margin portion to be cut) of the fixed form size, the toner image can be formed, and the control by which, when the image formation of a plurality of copies is conducted by making the plurality of pages of the recording sheets a unit, a predetermined patch image is formed in the margin portion, is conducted, and the control by which the patch image is attached to the same position for a plurality of recording sheets constituting the same page, is conducted. That is, at the time point when the page is changed, the control by which the position of the patch image is changed, is conducted.

Then, when the patch image in the margin portion is detected by the sensor, it can be used for the check of the image for the same page in each copy when the image formation of a plurality of pages is conducted over the plurality of copies by making the recording sheets of the plurality of pages a unit. Accordingly, at the time of this check, it becomes no necessary that the recording sheets are manually turned over carefully one by one sheet and the existence or not of the image is checked, or an exclusive use sensor is provided.

As the result, when the toner image corresponding to the fixed form size image data is formed on the recording sheet whose size is larger than the fixed form size, and outputted, by using the margin portion of the recording sheet which is finally cut, the check for each page at the time of bookbinding can be conducted.

(46) An image forming apparatus according to (20), wherein, when the image formation of a plurality of copies is conducted by making the recording sheets of the plurality of pages a unit, the control means conducts the control by which the patch image is attached to the same position for the plurality of recording sheets constituting the same page, and when the page is different, the patch image is attached to the different position.

In this invention, in (45), when the image formation of the plurality of copies is conducted by making the recording sheets of the plurality of pages a unit, the control by which the patch image is attached to the same position for the plurality of recording sheets constituting the same page, is conducted, and when the page is different, the control by which the patch image is attached to the different position, is conducted.

As the result, when the toner image corresponding to the fixed form size image data is formed on the recording sheet whose size is larger than the fixed form size, and outputted, by using the margin portion of the recording sheet which is finally cut, the check for each page of the plurality of pages at the time of bookbinding can be conducted.

(47) An image forming apparatus according to (45), wherein, when the image formation of the plurality of copies is conducted by making the recording sheets of the plurality of pages a unit, the control means conducts the control by which the patch image is attached to the same position for the plurality of recording sheets constituting the same page, and when the page is different, conducts the control by which the patch image is attached to the different position according to the setting value set by the operation input means.

In this invention, in (45), when the image formation of the plurality of copies is conducted by making the recording sheets of the plurality of pages a unit, the control by which the patch image is attached to the same position for the plurality of recording sheets constituting the same page, is conducted, and when the page is different, the control by which the patch image is attached to the different position according to the setting value for the changed distance in the main scanning direction or sub scanning direction set by the operation input means, is conducted.

As the result, when the toner image corresponding to the fixed form size image data is formed on the recording sheet whose size is larger than the fixed form size, and outputted, by using the margin portion of the recording sheet which is finally cut, the check for each page of the plurality of pages at the time of bookbinding can be surely conducted.

(48) An image forming apparatus according to any one of (45) to (47), wherein, when the double side image formation of the recording sheet is conducted, the control means conducts the control of the image formation so that the image formation areas of the front and rear of the recording sheet coincide with each other such that a portion outside the area of the fixed form size can be cut in 3 directions of the recording sheet, and conducts the control so that the patch image is formed in the margin of the recording sheet.

In this invention, in (45)–(47), when the double side image formation of the recording sheet is conducted, the control of the image formation is conducted so that the image formation areas of the front and rear of the recording sheet coincide with each other such that the cut in 3 directions can be conducted.

In this manner, when the image formation is conducted so that the image formation areas of the front and rear of the recording sheet coincide with each other, the image formation area of the front surface of the recording sheet coincides with the patch image position of the rear surface, and when the above check is conducted, the margin portion can be cut in 3 directions of the recording sheet.

(49) An image forming apparatus according to (48), wherein it has an operation input means for conducting the setting of the position of the patch image, and the control means independently conducts the control by which the patch image is formed in the margin of the recording sheet corresponding to the position set by the operation input means on each of the front and rear surface of the recording sheet.

In this invention, in (48), corresponding to the position set by the operation input means, the control by which the patch image is formed in the margin of the recording sheet is independently conducted on each of the front and rear surface of the recording sheets.

That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered on the front and rear, and the check can be surely conducted on each of the front and rear surface of the recording sheet.

(50) An image forming apparatus according to any one of (45) to (49), wherein it has the display means and the operation input means for conducting the initial setting and resetting of the position of the patch image, and after the patch image is formed corresponding to the initially set position, the control means displays the position resetting image plane for conducting the fine adjustment of the position of the patch image on the display means, and according to the value inputted into the operation input means according to the position resetting image plane, the control means controls so that the patch image is formed in the margin of the recording sheet.

In this invention, in (45)–(49), after the patch image is formed corresponding to the initially set position, the position resetting image plane for conducting the fine adjustment of the position of the patch image is displayed on the display means, and according to the value inputted into the operation input means according to the position resetting image plane, the control means controls so that the patch image is formed in the margin of the recording sheet.

That is, considering the shape or dimension of the margin portion of the recording sheet, or easiness of the checking of the patch image, or relationship with the image in the image formation area, when the user resets the appropriate position by referring to the output of the recording sheet, the telescopic motion of the recording sheet by the fixing, or the slippage of the reading timing is dissolved, and the above check can be surely conducted.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENT

Figure 1:
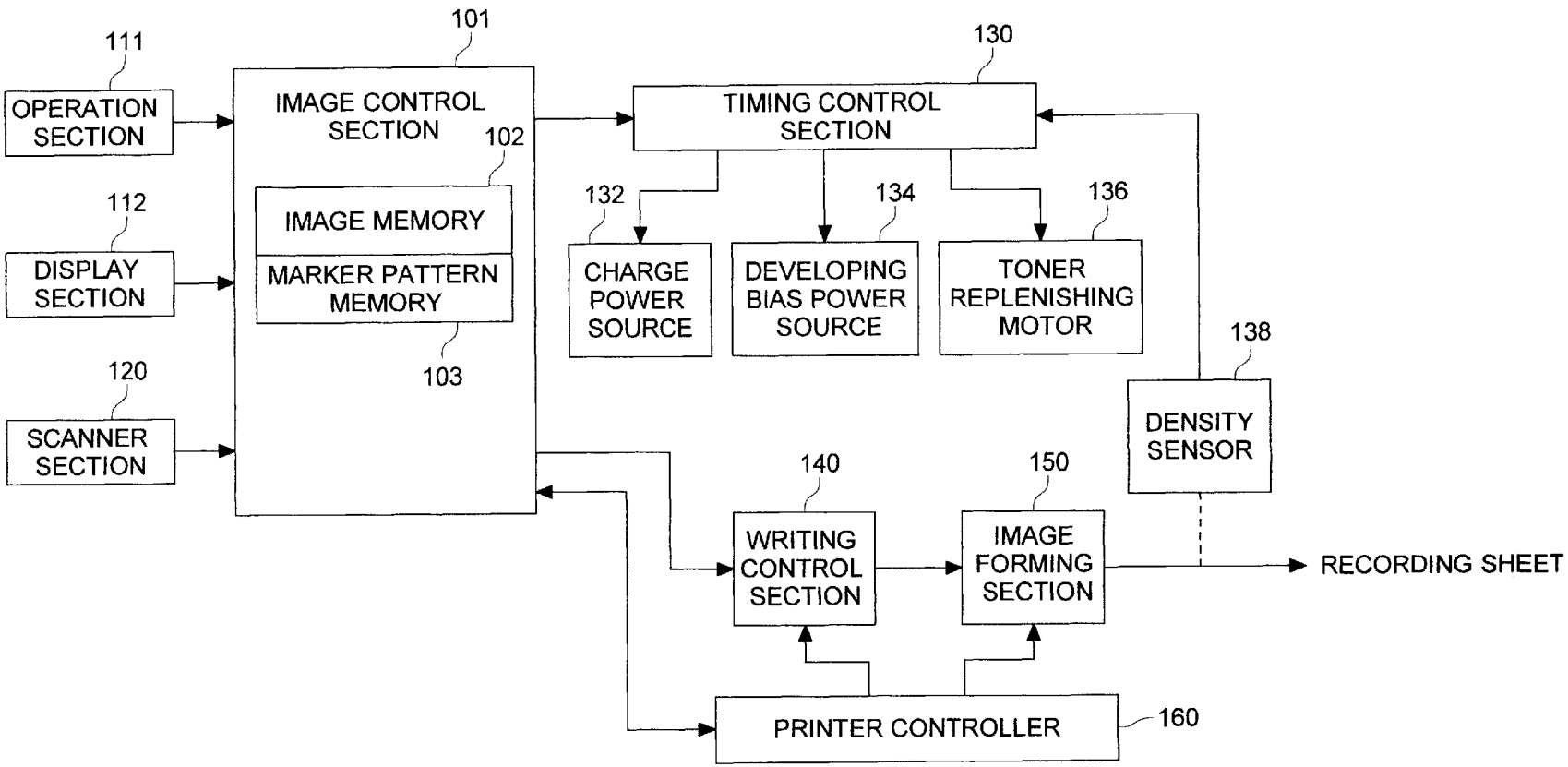
FIG. 1 is a circuit structural view showing an electric structure of an image forming apparatus of an embodiment of the present invention.

Referring to the drawings, an embodiment of the present invention will be detailed below.

Structure of an Image Forming Apparatus

Figure 2:
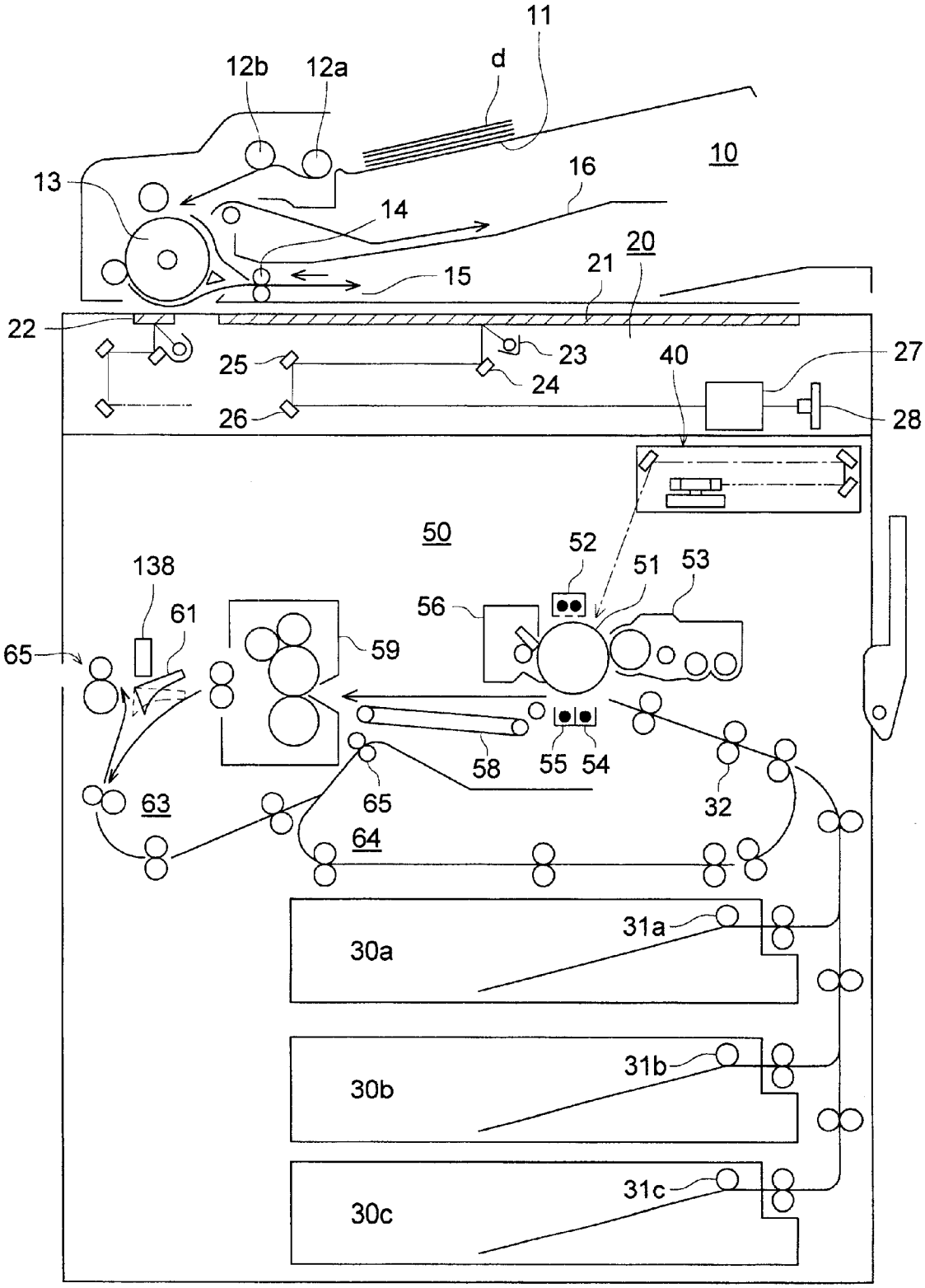
FIG. 2 is a sectional structural view showing a mechanical structure of the image forming apparatus of the embodiment of the present invention.

Initially, referring to FIG. 2, a mechanical structure of the image forming apparatus will be detailed. In this connection, herein, the image forming apparatus as a copier which reads an image of a document and forms the image is used as a specific example.

In FIG. 2, numeral 10 is an automatic document feeding means (hereinafter, called ADF), and is a means for conducting the sheet feeding for reading double sides of the document. Numeral 20 is an image reading section (scanner) which optically scans the document, reads it and generates the image data. Numeral 40 is an image writing section to generate an exposure light beam corresponding to the image data. Numeral 50 is an image forming section to record the image data onto a recording medium (called transfer sheet or recording sheet, but in the present specification, called recording sheet) p by an electrostatic method. Numeral 60 is a conveying means for conducting the conveying of the recording sheet.

In this connection, this image forming section 50 is structured in such a manner that, when a toner image corresponding to a fixed form size image data is formed on the recording sheet whose size is larger than the fixed form size and outputted, it forms the toner image corresponding to the fixed form size image data in an area of the fixed form size of the recording sheet, and also in the outside of the area (margin portion which will be cut) of the fixed form size of the recording sheet, the toner image can be formed. That is, it is assumed to be structured so that, in each step of the exposure, electrostatic latent image formation, development, transfer, and fixing, the image formation in the outside of the area of the fixed form size can be conducted.

Herein, on a document placement portion 11 of the ADF 10 which can conduct double side feeding of the document, a plurality of the documents d whose first page surface is facing upward, are placed. The first sheet of the document fed through a roller 12*a,* and roller 12*b* is rotated through a roller 13.

In this case, the document surface of the document d is irradiated by a light source 23, and the reflected light forms an image on the light receiving surface of a CCD 28 which is photoelectric conversion means, through an image forming optical system 27 through mirrors 24, 25 and 26. Herein, an optical system having the light source 23, mirrors 24, 25 and 26, image forming optical system 27 and CCD 28, and an optical system drive means, not shown, structure an image reading section 20.

In this drawing, when the documents d are placed on a platen glass 21 under the condition that a reading surface faces downward, the optical system scans it along the platen glass 21 and reads it.

Further, when the document d is automatically fed and rotated around the roller 13, the reading is conducted under the condition that the light source 23 and mirror 24 are fixed below the second platen glass 22. Then, the image data of the read document d is sent from the CCD 28 to a reading image processing section, not shown.

In this connection, in the case where the document d is automatically fed by the ADF 10, when the first page of the document is read, the winding operation by using the roller 13 through a reversal roller 14 is conducted again this time, and the image of the document rear surface is read by the image reading section 20, and sent to the reading image processing section.

In this manner, the document d in which the images of the front surface and rear surface are read, is reversed again by the reversal roller 14, and stacked on the sheet delivery tray 16 under the condition that the front surface faces downward. In this manner, after the image data read by the image reading section 20 is subjected to the predetermined image-processing in the reading image processing section, it is compressed by the compression elongation circuit and stored in an image memory.

On the one hand, from any one of sheet feed trays 30*a*–30*c* on which the recording sheet p is stacked, the recording sheet p is fed by the first sheet feed rollers 31*a*–31*c,* and sent to the image forming section 50. In this connection, in order to form the toner image corresponding to the image data of the fixed form size on the recording sheet whose size is larger than the fixed form size, and to output, in the image forming apparatus of the present embodiment, the recording sheet whose size is larger than the fixed form size (wide sheet) is accommodated in any one the sheet feed trays 30*a*–30*c*.

The recording sheet p sent to the image forming section 50, after it is synchronized on the second sheet feed roller (register roller) 32 in the vicinity of its inlet, approaches the photoreceptor drum 51 which is an image carrier.

The image data is inputted from the recording image processing section to the image writing section 40, and the laser light corresponding to the image data is irradiated from the laser diode in the image writing section 40 onto the photoreceptor drum 51, and an electrostatic latent image is formed. When this electrostatic latent image is developed by the developing section 53, the toner image is formed on the photoreceptor drum 51.

In this connection, the photoreceptor drum 51 in the present embodiment, when the toner image corresponding to the image data of the fixed form size is formed on the recording sheet whose size is larger than the fixed form size, and outputted, is structured in such a manner that it forms the toner image corresponding to the image data of the fixed form size in the area of the fixed form size of the recording sheet, and also in the outside of the area (margin portion to be cut) of the fixed form size of the recording sheet, the toner image can be formed.

This toner image is transferred onto the recording sheet p by the transfer section 54 arranged below the photoreceptor drum 51. Then, the recording sheet p which is in pressure-contacted with the photoreceptor drum 51 is separated by a separation section 55. The recording sheet p separated from the photoreceptor drum 51 enters into the fixing section 59 through the conveying mechanism 58, and the toner image is fixed by the heat and pressure. In this manner, the image is formed on the recording sheet p.

In this connection, the recording sheet p on which the toner image is fixed is conveyed lower through the guide 61, and enters into the reversal section 63. Next, the recording sheet p in the reversal section 63 is fed again by the reversal roller 62, and through the reversal conveying path 64, sent again to the image forming section 50. In the image forming section 50 by which the image formation of the single surface of the document d is completed, the toner adhered onto the photoreceptor drum 51 is removed by the cleaning section 56, and is charged by the charging section 52, and stands by the next image formation.

Under this condition, the other surface (not yet image formed surface) of the recording sheet p is conveyed into the image forming section 50, and the image is formed. The recording sheet p separated from the photoreceptor drum 51 by the separation section 55 enters again into the fixing section 59 through the conveying mechanism 58 and is fixed.

Then, a density sensor 138 to detect the position, shape, and density of the patch image pp in the margin portion of the recording sheet p which is fixed in the fixing section 59, is provided. In the present embodiment, when the toner image corresponding to the image data of the fixed form size is formed on the recording sheet whose size is larger than the fixed form size and outputted, it is structured such that the toner image can be formed also in the outside of the area (margin portion of the recording sheet which is finally cut) of the fixed form size of the recording sheet, and is controlled so that a predetermined patch image is formed in the margin portion. Then, the density sensor 138 detects the patch image.

Figure 3:
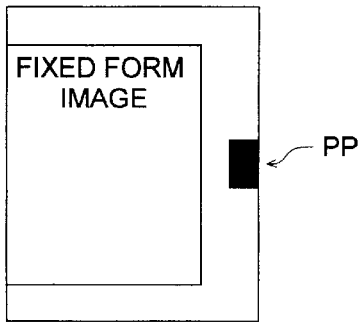
FIG. 3(*a*), FIG. 3(*b*), FIG. 3(*c*) and FIG. 3(*d*) are illustrations showing examples of a patch image generated by the image forming apparatus of the embodiment of the present invention.
Figure 3:
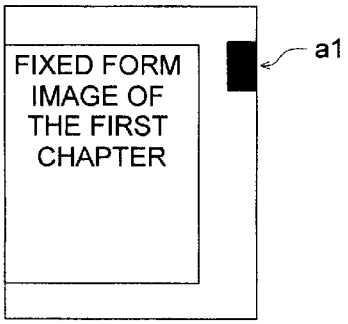
Figure 3:
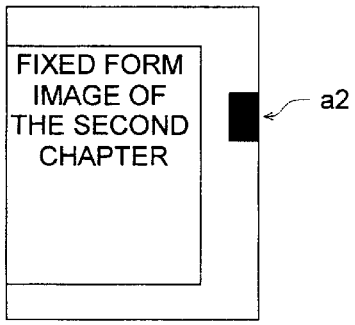
Figure 3:
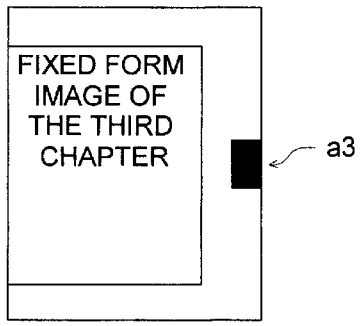
Figure 4:
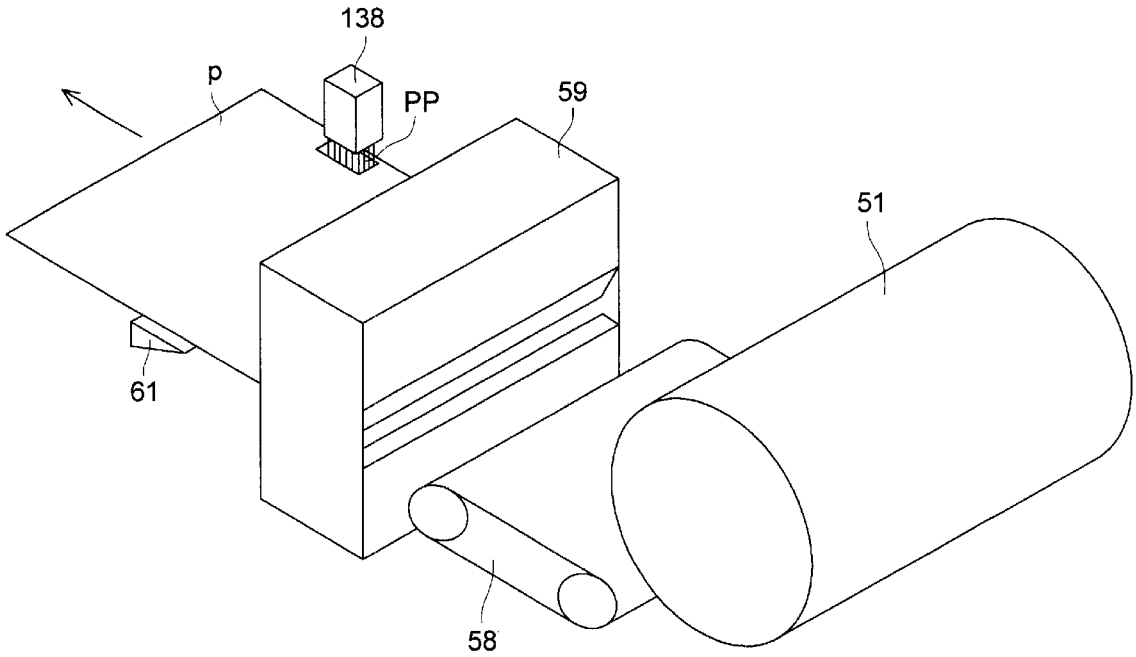
FIG. 4 is an illustration showing an arrangement example of each portion of the image forming apparatus of the present invention.

In this connection, because the patch image pp in the margin portion is formed at each of predetermined positions as shown in FIG. 3(*a*), FIG. 3(*b*), FIG. 3(*c*) and FIG. 3(*d*), it is assumed that the density sensor 138 is arranged at the position appropriate for detection of the patch image pp as shown in FIG. 4.

In this manner, the image formation of the rear surface and the front surface is completed, and the recording sheet p for which the check of the patch image pp is conducted, or the recording sheet p on which the image formation of one surface is completed, is delivered.

Next, in FIG. 1 which is an electric block diagram, the electric structure will be described. In this connection, herein, by limiting to the function necessary for the operations of the present embodiment, it will be described.

Numeral 101 is a image control section to conduct each kind of control for the image, and is structured by providing with the image memory 102 in which the image data is developed when the image is processed, and a marker pattern memory 103 in which the data for the patch image is previously accommodated.

Numeral 111 is an operation section into which each kind of operation is inputted, and in the present embodiment, it structures the operation input means by which the setting (initial setting, resetting) of the position of the patch image is conducted. Numeral 112 is a display section to conduct the display at the time of the each kind of operation, and the display of the condition of the device. In this connection, it may also be an operation display section which is integrated with the operation section 111 and the display section 112.

Numeral 120 is a scanner section and is an electric structural portion of the image reading section which optically scans the document and reads it and generates the image data. In this connection, there can also be a case where, other than the scanner section 120, the image data is directly supplied to the image control section 101 from the outside device.

Numeral 130 is a timing control section to control the timing of each portion, and controls the charging power source 132 to charge the photoreceptor drum 51, developing bias power source 134 to apply the developing bias voltage onto the developing section 53, and toner replenishing motor 136 to replenish the toner to the developing section 53. Further, the detection result of the density sensor 138 to detect the density of the patch image of the recording sheet on which the image is formed, is also supplied to the timing control section 130.

Numeral 140 is a writing control section to conduct the control of the writing (image (electrostatic latent image) formation) into the photoreceptor drum 51. Numeral 150 is an image forming section to conduct the image formation after the image data controlled by the writing control section 140 is received, and is a portion corresponding to the image forming section 50 in FIG. 2.

Numeral 160 is a printer controller to control the print (whole of the image formation), and controls the image formation by the writing control section 140 and image forming section 150.

In this connection, the image control section 101, timing control section 130, writing control section 140, and printer controller 160 structure the control means in the present invention.

Then, it is assumed that the image forming apparatus in the present embodiment is structured so that it forms the toner image corresponding to the image data of the fixed form size in an area of the fixed form size of the recording sheet, and also in the outside of the area of the fixed form size of the recording sheet, the toner image can be formed.

Operation Condition of the Embodiment

Herein, referring to an image control flow chart in FIG. 5 and a timing control flow chart in FIG. 6, the operation of the image forming apparatus of the present embodiment will be described.

In this connection, in the present embodiment, it is defined that the patch image formed with the predetermined shape at a predetermined position outside the area of the fixed form size of the recording sheet (margin portion to be cut) is called "marker".

The image formation of the existence of marker (hereinafter, "marker specification") from the user of the image forming apparatus (hereinafter, "user") is conducted in the operation section 111. This marker specification may be a specification for each job, or may be a continuous specification for the whole image formation during a period until the setting change is conducted. Further, when the document is not read in the scanner section 120, and the image data to conduct the image formation is given from the outside device, it is defined that the marker specification is also given as the control data together with the image data.

Figure 5:
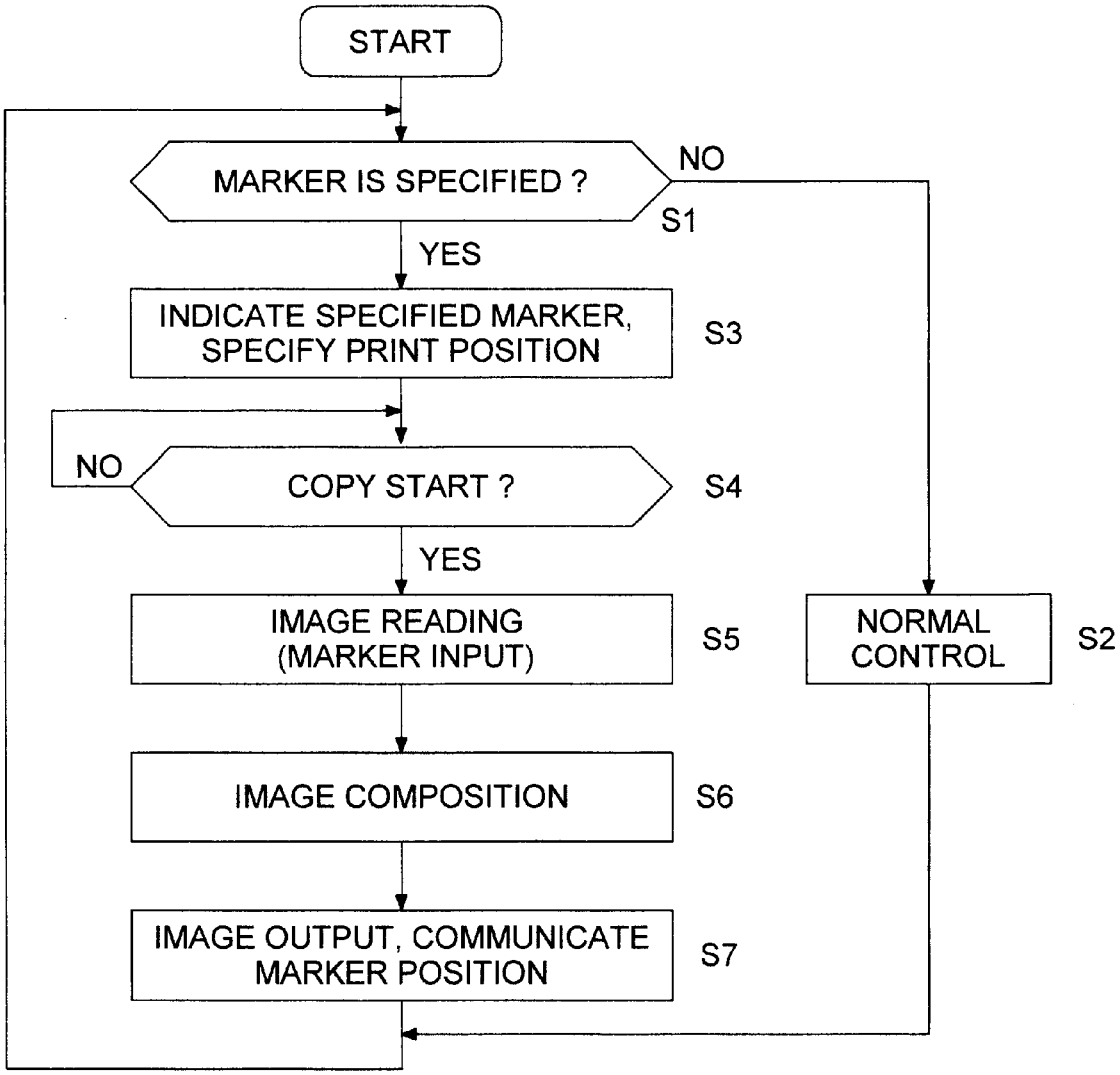
FIG. 5 is a flow chart showing the motion of the image forming apparatus of the embodiment of the present invention.

When the marker is not specified (NO in S1 of FIG. 5), the image control section 101 conducts normal image control (normal control in S2 of FIG. 5). Further, the timing control section 130 conducts the normal timing control(normal control in S2 of FIG. 6).

On the one hand, when the marker is specified (YES in S1 of FIG. 5), the image control section 101 receives the indication of the kind of the marker specified from the operation section 111 or the outside device (marker for double feeding check, marker for each page check, marker for each chapter check, or marker for each copy check when the image formation of a plurality of copies is conducted by making the recording sheet of a plurality of pages or a plurality of chapters a unit) and the information of the specification of the position of the marker (S3 of FIG. 5).

Then, when, in the case of a copier, a copy start button is pressed (YES in S4 of FIG. 5), or when, in the case of a printer, the image formation is indicated, the image data is read in the image memory 102 in the image control section 101, or the image data is developed. Further, corresponding to the kind of specified marker (marker for double feeding check, marker for each page check, marker for each chapter check, or marker for each copy check when the image formation of a plurality of copies is conducted by making the recording sheet of a plurality of pages or a plurality of chapters a unit), the information of the shape of the corresponding marker or the position in the recording sheet margin portion is read from the marker pattern memory 103 (S5 in FIG. 5).

Figure 6:
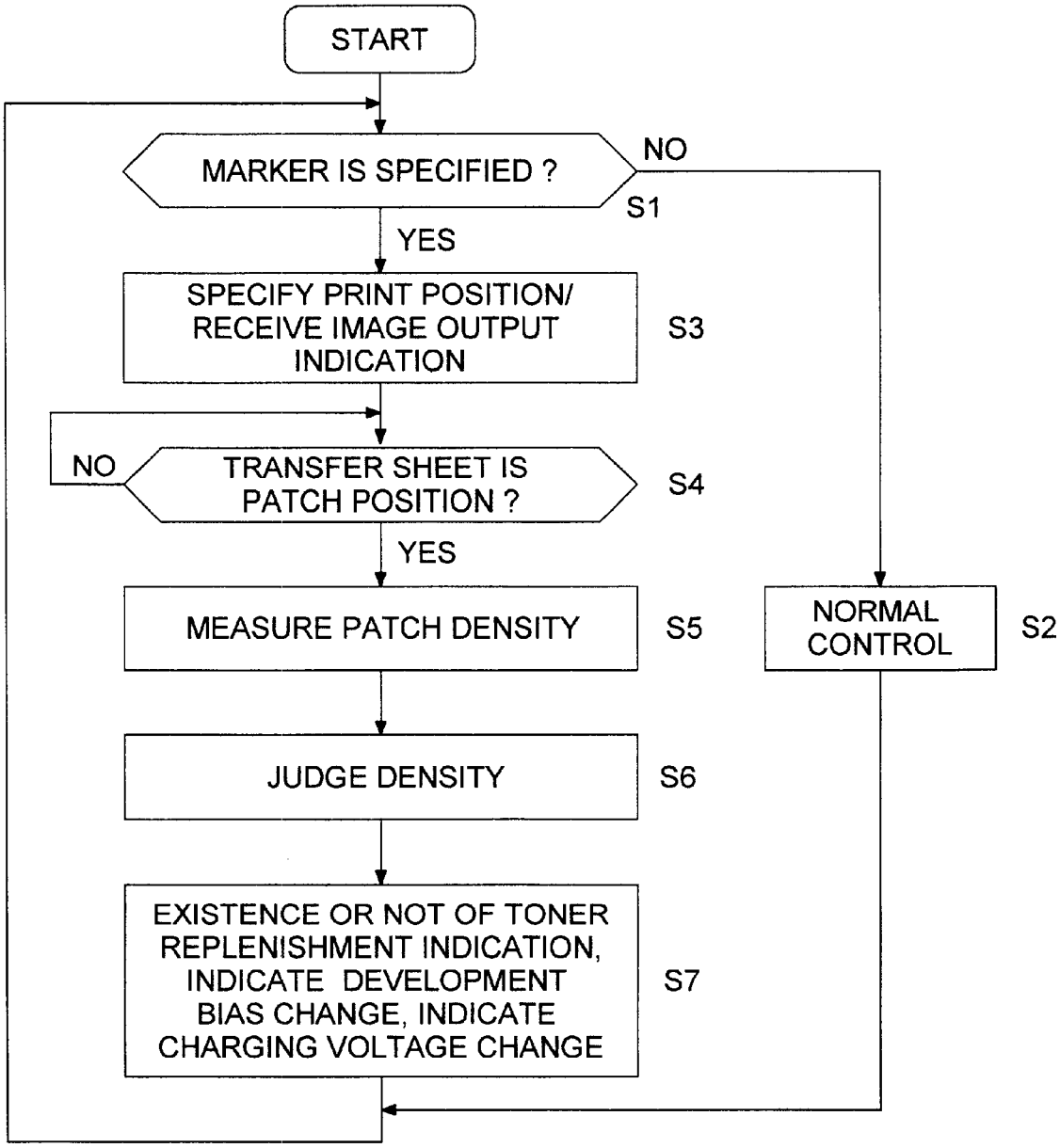
FIG. 6 is a flow chart showing the motion of the image forming apparatus of the embodiment of the present invention.

Then, the image control section 101 composes the image data of the fixed form size with the marker pattern in the outside of the area of the fixed form size, and the image data in which the image data in the area of the fixed form size and the marker pattern in the outside of the area of the fixed form size in the area of the wide sheet are composed is generated (S6 in FIG. 6).

As described above, by the new image data which is obtained by composing the image data and marker pattern, the writing control section 140 and image forming section 150 conduct the image formation including the margin portion of the wide sheet, and the recording sheet is outputted outside the image forming apparatus (S7 in FIG. 6). In this connection, the image control section 101 notices the information about the position at which the marker pattern is formed, to the timing control section 130.

In the manner as described above, when the image attached with the marker according to the image control flow chart is formed and outputted, the timing control section 130 conducts the timing control as will be described below.

When the marker is not specified (NO in S1 of FIG. 6), the timing control section 130 conducts the normal timing control (normal control, S2 in FIG. 6). On the one hand, when the marker is specified (YES in S1 of FIG. 6), the timing control section 130 receives the information of the indication of the kind of the specified marker (marker for double feeding check, marker for each page check, marker for each chapter check, or marker for each copy check when the image formation of a plurality of copies is conducted by making the recording sheet of a plurality of pages or a plurality of chapters a unit), and the specification of the position of the marker from the image control section 101 (S3 in FIG. 6).

Then, the recording sheet on which the image is formed together with the marker in the image forming apparatus is outputted, and as shown in FIG. 4, the density sensor 138 detects the density of the marker (patch image attached to the margin portion of the transfer sheet) at the timing (YES in S4 of FIG. 6) at which the density sensor 138 comes to the position of the patch image (S5 in FIG. 6). The detection result of this density sensor is supplied to the timing control section 130, and the density judgement (S6 in FIG. 6) is conducted. This density judgement is conducted when the error between the detection result of the density sensor 138 and the specified density of the marker is compared with each other.

Then, according to the result of this density judgement, the timing control section 130 conducts the density control (S7 in FIG. 6) by the charge voltage control by the control of the charge power source 132 in the image forming section, toner density control by the control of the developing bias power source 134 in the developing section, toner density control by the drive of the toner replenishing motor 136 in the developing section. That is, in order to detect whether the desired density is stably formed on the image, when the patch image of the margin portion of the recording sheet, not the patch image on the photoreceptor surface, is detected by the sensor, the density of the image actually formed on the recording sheet can be checked.

Further, in this manner, when the patch image in the margin portion is detected by the sensor 138, it can also be used for the double feeding check, or the check of the image of each page, each chapter, and each copy when the image formation of the plurality of copies is conducted by making the recording sheet of the plurality of pages or plurality of chapters a unit. In this case, when the marker for double feeding check attached to the same position as shown in FIG. 3(*a*) can not be detected at the predetermined timing (S4 in FIG. 6) (density=0), it can be judged that it is an inappropriate recording sheet generated by the double feeding. Accordingly, when these checks are conducted, it becomes unnecessary that the recording sheets are manually turned over one by one sheet carefully, and the existence of the image is checked, or an exclusive use sensor is provided.

In this connection, in the operations described above, although the patch image (marker) is normally formed corresponding to the initially set position, just after the time, the fine adjustment of the marker position can be conducted. In this connection, when this marker position is finely adjusted, it is very troublesome that the user itself successively operates the menu image plane formed of the hierarchic structure.

Figure 7:
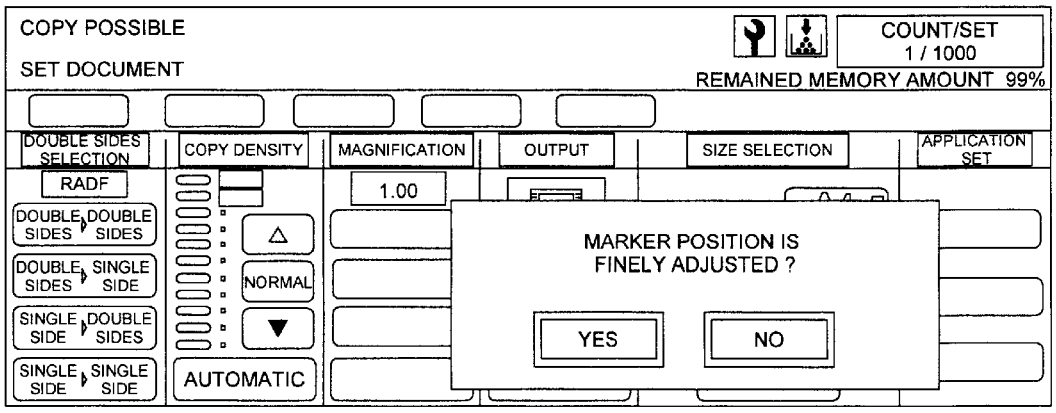
FIG. 7 is an illustration showing a display image plane example by a binary image in the motion of the image forming apparatus of the embodiment of the present invention.
Figure 8:
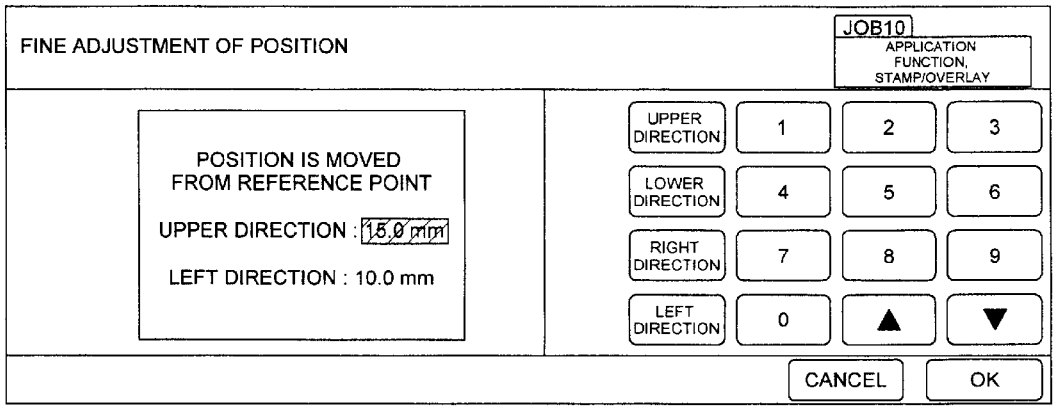
FIG. 8 is an illustration showing a display image plane example by a binary image in the motion of the image forming apparatus of the embodiment of the present invention.

Accordingly, corresponding to the initially set position, just after the patch image (marker) is formed, a window whether the marker position fine adjustment is conducted, is displayed on the display image plane of the display section 112 (FIG. 7). When "YES" is selected in this window, succeedingly, the position resetting image plane for conducting the fine adjustment of the position of the patch image is displayed on the display section 112. Then, in the position resetting image plane, it is made so that the fine adjustment amount from the initially set position can be inputted in the upper, lower, left and right directions.

Thereby, considering the shape or dimension of the margin portion of the recording sheet, or easiness of the checking of the patch image, or relationship with the image in the image formation area, when the user resets the appropriate position referring to the output of the recording sheet, the telescopic motion of the recording sheet by the fixing, or the slippage of the reading timing is dissolved, and the check can be more surely conducted.

The effects of the embodiments in the configurations and the operations as aforementioned and the effects of modified examples will be detailed in the following.

(1) In this embodiment, when the toner image corresponding to the fixed form sized image data is formed on the recording sheet whose size is larger than the fixed form size and outputted, the toner image corresponding to the fixed form sized image data is formed in the area of the fixed form size of the recording sheet, and it is made in such a manner that, also in the outside of an area of the fixed form size of the recording sheet (margin portion to be cut), toner image can be formed, and controlled so that a predetermined patch image is formed on the margin portion. Then, when the patch image in this margin portion is detected by a sensor, it can be used for the double feeding check, or also for the check of the image of each page, each chapter, each copy when the image formation of a plurality of copies is conducted by making the recording sheet of a plurality of pages or a plurality of chapters a unit. Accordingly, when they are checked, it is not necessary that the recording sheet is manually turned over one by one sheet carefully and the existence or not of the image is checked, or an exclusive use sensor is provided. Further, in order to detect that the desired density is stably formed on the image, when the patch image in the margin portion of the recording sheet, not the patch image on the photoreceptor surface, is detected by a sensor, the density of the image actually formed on the recording sheet can be checked. As the result, when the toner image corresponding to the fixed form sized image data is formed on the recording sheet whose size is larger than the fixed form size and outputted, by using the margin portion of the recording sheet which is finally cut, each kind of check can be conducted.

(2) In this embodiment, in (1), the predetermined patch image is formed so as to have the dimension within the range which can be accommodated in the outside of the fixed form size area, and it is controlled so that the patch image is formed at the same position on a plurality of recording sheets. According to this, the double feeding of the recording sheet can be simply and surely detected according to the existence or not of this patch image. Further, because a check of only the sheet end portion is allowed, there is no influence on the formed image.

(3) In this embodiment, in (1) or (2), when the double side image formation of the recording sheet is conducted, the control means controls so that the image is formed in the area in which the image formation area of the front surface of the recording sheet coincides with the image formation area of the rear surface, in order that the portion (margin portion) of the outside of the area of the fixed form size may be cut in the 3 directions of the recording sheet, and the patch image is formed in the margin of the recording sheet. In this manner, when the image is formed in the area in which the image formation area of the front surface of the recording sheet coincides with the image formation area of the rear surface, and the patch image is formed in the margin of the recording sheet, the checks in (1) and (2) are conducted, and the margin portion can be cut in the 3 directions of the recording sheet.

(4) In this embodiment, in (1)–(3), corresponding to the density of the patch image, the density of the toner used for the development or the developing bias voltage, or the charging voltage used for the transfer is controlled. In this manner, when the patch image in a predetermined portion in the margin portion of the recording sheet is detected by the sensor, the density of the image actually formed on the recording sheet can be surely checked, and it can be controlled so that the desired density is stably formed on the image.

(5) In this embodiment, in (1)–(4), it is controlled so that the patch image is formed in the margin of the recording sheet corresponding to the position set by the operation input means. That is, considering the shape or dimension of the margin portion of the recording sheet, or easiness of the checking of the patch image, or relationship with the image in the image formation area, when the user selects the appropriate position, the check can be surely conducted.

(6) In this embodiment, in (1)–(4), corresponding to the position set by the operation section 111, the control by which the patch image is formed in the margin of the recording sheet, is independently conducted in each of the front and rear of the recording sheet. That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered at the front and rear, and the check can be surely conducted in each of the front and rear of the recording sheet.

(7) In this embodiment, in (1)–(6), it is controlled so that, after the patch image is formed corresponding to the initially set position, the position resetting image plane for conducting the fine adjustment of the position of the patch image is displayed on the display section 112, and according to the value inputted into the operation input section 111 according to the position resetting image plane, the patch image is formed in the margin of the recording sheet. That is, considering the shape or dimension of the margin portion of the recording sheet, or easiness of the checking of the patch image, or relationship with the image in the image formation area, when the user resets the appropriate position referring to the output of the recording sheet, the telescopic motion of the recording sheet by the fixing, or the slippage of the reading timing is dissolved, and the check can be more surely conducted.

(8) In this embodiment, when the toner image corresponding to the fixed firm size image data is formed on the recording sheet whose size is larger than the fixed form size, and outputted, the toner image corresponding to the fixed form size image-data is formed in the fixed form size area of the recording sheet, and it is made in such a manner that the toner image can be formed also in the outside of the fixed form size area (margin portion to be cut) of the recording sheet, and when the image formation of the plurality of chapters is conducted on the plurality of recording sheets, the predetermined patch image is formed in the margin portion, and the control by which the patch image is attached to the same position for the plurality of recording sheets constituting the same chapter, is conducted. That is, at the time point when the chapter is changed, the control by which the position of the patch image is changed, is conducted (refer to a1 in FIG. 3(*b*), a2 in FIG. 3(*c*) and a3 in FIG. 3(*d*)). Then, when the patch image of the margin portion is detected by the sensor, it can be used for the check of the images of each chapter when the image formation of the plurality of copies is conducted by making the recording sheets of the plurality of pages or plurality of chapters a unit. Accordingly, at the time of the check, it becomes not necessary that the recording sheets are manually turned over one by one sheet carefully and the existence or not of the image is checked, or exclusive use sensor is provided. As the result, when the toner image corresponding to the image data of the fixed form size is formed on the recording sheet whose size is larger than the fixed form size, and outputted, by using the margin portion of the recording sheet which is finally cut, the check for each chapter at the time of bookbinding can be conducted.

(9) In this embodiment, in (8), when the image formation of the plurality of chapters is conducted on the plurality of recording sheets, it is controlled that the patch image is attached to the same position for the plurality of recording sheets constituting the same chapter, and when the chapter of the plurality of recording sheets is different, the patch image is attached to the different positions. As the result, when the toner image corresponding to the fixed form size image data is formed on the recording sheet whose size is larger than the fixed form size and outputted, by using the margin portion of the recording sheet which is finally cut, the check for each chapter for the plurality of chapters at the time of bookbinding, can be conducted.

(10) In this embodiment, in (8), when the image formation of the plurality of chapters is conducted on the plurality of recording sheets, the control by which the patch image is attached to the same position for the plurality of recording sheets constituting the same chapter, is conducted, and when the chapter of the plurality of the recording sheets is different, the control by which the patch image is attached to the different position (shifted amount in the main-scanning direction or sub-scanning direction, showing as a1 in FIG. 3(*b*), a2 in FIG. 3(*c*) and a3 in FIG. 3(*d*)) according to the setting value, is conducted. In this result, when the toner image corresponding to the fixed form size image data is formed on the recording sheet whose size is larger than the fixed form size, and outputted, by using the margin portion of the recording sheet which is finally cut, the check for each chapter for the plurality of chapters at the time of bookbinding can be surely conducted.

(11) In this embodiment, in (8)–(10), when the double side image formation of the recording sheet is conducted, the image formation is controlled such that the image formation areas of the front and rear of the recording sheet coincide with each other so that the 3 direction cutting can be conducted. When the image is formed so that the image formation areas of the front and rear of the recording sheet coincide with each other, the image formation area of the front surface of the recording sheet coincides with the patch image position of the rear surface, and the check is conducted, and the margin portion can be cut in the 3 direction of the recording sheet.

(12) In this embodiment, in (11), corresponding to the position set by the operation section 111, the control by which the patch image is formed in the margin of the recording sheet is independently conducted in each of the front and rear of the recording sheet. That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered in the front and rear, and the check can be surely conducted in each of the front and rear of the recording sheet.

(13) In this embodiment, in (8)–(12), after the patch image is formed corresponding to the initially set position, the position resetting image plane for conducting the fine adjustment of the position of the patch image is displayed on the display section 112, and according to the value inputted into the operation input section 111 according to the position resetting image plane, the control means controls so that the patch image is formed in the margin of the recording sheet. That is, considering the shape or dimension of the margin portion of the recording sheet, or easiness of the checking of the patch image, or relationship with the image in the image formation area, when the user resets the appropriate position referring to the output of the recording sheet, the telescopic motion of the recording sheet by the fixing, or the slippage of the reading timing is dissolved, and the check can be surely conducted.

(14) In this embodiment, when the toner image corresponding to the fixed form size image data is formed on the recording sheet whose size is larger than the fixed form size, and outputted, it is made so that the toner image corresponding to the fixed form size image data is formed in the area of the fixed form size of the recording sheet, and in also the outside of the area (margin portion to be cut) of the fixed form size of the recording sheet, the toner image can be formed, and the control by which, when the image formation of a plurality of copies is conducted by making the plurality of recording sheets a unit, the patch image is attached to the same position for a plurality of recording sheets constituting the same copy, is conducted. That is, at the time point when the copy is changed, the control by which the position of the patch image is changed, is conducted (refer to b1 in FIG. 9(*a*), b2 in FIG. 9(*b*) and b3 in FIG. 9(*c*)). Then, when the patch image in the margin portion is detected by the sensor, it can be used for the check of the image for the same copy when the image formation of a plurality of copies is conducted by making the recording sheets of the plurality of copies a unit. Accordingly, at the time of this check, it becomes no necessary that the recording sheets are manually turned over carefully one by one sheet and the existence or not of the image is checked, or an exclusive use sensor is provided. As the result, when the toner image corresponding to the fixed form size image data is formed on the recording sheet whose size is larger than the fixed form size, and outputted, by using the margin portion of the recording sheet which is finally cut, the check for each copy at the time of bookbinding can be conducted.

(15) In this embodiment, in (14), when the image formation of a plurality of copies is conducted by making a plurality of recording sheets a unit, the control by which the patch image is attached to the same position for the plurality of recording sheets constituting the same copy, is conducted, and the control by which the patch image is attached to the different position when the copy is different, is conducted. As the result, when the toner image corresponding to the fixed form size image data is formed on the recording sheet whose size is larger than the fixed form size, and outputted, by using the margin portion of the recording sheet which is finally cut, the check for each copy of the plurality of copies at the time of bookbinding can be conducted.

Figure 9:
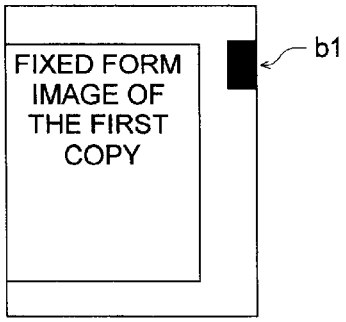
FIG. 9(*a*), FIG. 9(*b*) and FIG. 9(*c*) are illustrations showing examples of a patch image generated by the image forming apparatus embodied in the present invention.
Figure 9:
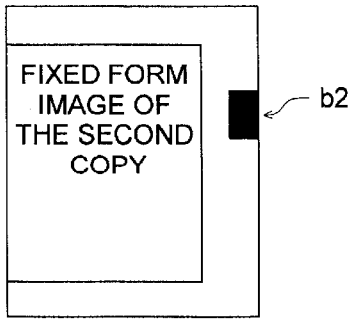
Figure 9:
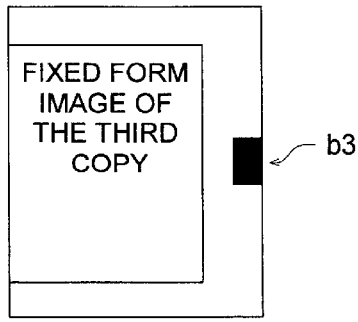

(16) In this embodiment, in (14), when the image formation of a plurality of copies is conducted by making a plurality of recording sheets a unit, the control by which the patch image is attached to the same position for the plurality of recording sheets constituting the same copy, is conducted, and when the copy is different, the control by which the patch image is attached to the different position (shifted amount in the main-scanning direction or sub-scanning direction of each patch, showing as b1 in FIG. 9(*a*), b2 in FIG. 9(*b*) and b3 in FIG. 9(*c*)) according to the setting value set by the operation input means, is conducted. As the result, when the toner image corresponding to the fixed form size image data is formed on the recording sheet whose size is larger than the fixed form size, and outputted, by using the margin portion of the recording sheet which is finally cut, the check for each copy of the plurality of copies at the time of bookbinding can be surely conducted.

(17) In this embodiment, in (14)–(16), when the double side image formation of the recording sheet is conducted, the control of the image formation is conducted so that the image formation areas of the front and rear of the recording sheet coincide with each other so as to be able to be cut in the 3 directions. In this manner, when the image formation is conducted so that the image formation areas of the front and rear of the recording sheet coincide with each other, the image formation area of the front surface of the recording sheet coincides with the patch image position of the rear surface, and when the above check is conducted, the margin portion can be cut in 3 directions of the recording sheet.

(18) In this embodiment, in (17), corresponding to the position set by the operation section 111, the control by which the patch image is formed in the margin of the recording sheet, is independently conducted on each of the front and rear surface of the recording sheet. That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered on the front and rear, and the check can be surely conducted on each of the front and rear surface of the recording sheet.

(19) In this embodiment, in (14)–(18), after the patch image is formed corresponding to the initially set position, the position resetting image plane for conducting the fine adjustment of the position of the patch image is displayed on the display section 112, and according to the value inputted into the operation input section 111 according to the position resetting image plane, the control means controls so that the patch image is formed in the margin of the recording sheet. That is, considering the shape or dimension of the margin portion of the recording sheet, or easiness of the checking of the patch image, or relationship with the image in the image formation area, when the user resets the appropriate position referring to the output of the recording sheet, the telescopic motion of the recording sheet by the fixing, or the slippage of the reading timing is dissolved, and the check can be surely conducted.

(20) In this embodiment, when the toner image corresponding to the fixed form size image data is formed on the recording sheet whose size is larger than the fixed form size, and outputted, it is made so that the toner image corresponding to the fixed form size image data is formed in the area of the fixed form size of the recording sheet, and in also the outside of the area (margin portion to be cut) of the fixed form size, the toner image can be formed, and the control by which, when the image formation of a plurality of copies is conducted by making the plurality of pages of the recording sheets a unit, a predetermined patch image is formed in the margin portion, is conducted, and the control by which the patch image is attached to the same position for a plurality of recording sheets constituting the same page, is conducted. That is, at the time point when the page is changed, the control by which the position of the patch image is changed, is conducted (refer to c1 in FIG. 10(*a*), c2 in FIG. 10(*b*) and c3 in FIG. 10(*c*)). Then, when the patch image in the margin portion is detected by the sensor, it can be used for the check of the image for the same page in each copy when the image formation of a plurality of pages is conducted over the plurality of copies by making the recording sheets of the plurality of pages a unit. Accordingly, at the time of this check, it becomes no necessary that the recording sheets are manually turned over carefully one by one sheet and the existence or not of the image is checked, or an exclusive use sensor is provided. As the result, when the toner image corresponding to the fixed form size image data is formed on the recording sheet whose size is larger than the fixed form size, and outputted, by using the margin portion of the recording sheet which is finally cut, the check for each page at the time of bookbinding can be conducted. Namely, the finisher for sorting the recording sheets is not necessary.

(21) In this embodiment, in (20), when the image formation of the plurality of copies is conducted by making the recording sheets of the plurality of pages a unit, the control by which the patch image is attached to the same position for the plurality of recording sheets constituting the same page, is conducted, and when the page is different, the control by which the patch image is attached to the different position, is conducted. As the result, when the toner image corresponding to the fixed form size image data is formed on the recording sheet whose size is larger than the fixed form size, and outputted, by using the margin portion of the recording sheet which is finally cut, the check for each page of the plurality of pages at the time of bookbinding can be conducted.

Figure 10:
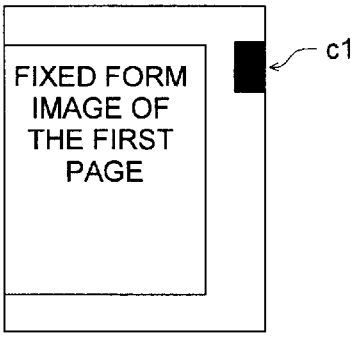
FIG. 10(*a*), FIG. 10(*b*) and FIG. 10(*c*) are illustrations showing examples of a patch image generated by the image forming apparatus embodied in the present invention.
Figure 10:
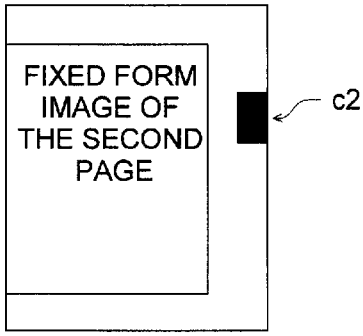
Figure 10:
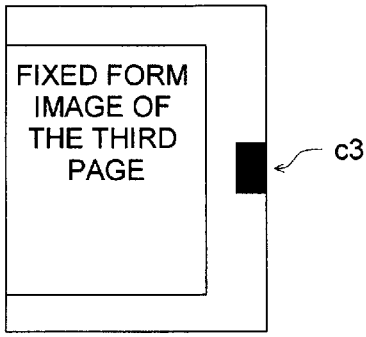

(22) In this embodiment, in (20), when the image formation of the plurality of copies is conducted by making the recording sheets of the plurality of pages a unit, the control by which the patch image is attached to the same position for the plurality of recording sheets constituting the same page, is conducted, and when the page is different, the control by which the patch image is attached to the different position (shifted amount in the main-scanning direction or sub-scanning direction of each patch, showing as c1 in FIG. 10(*a*), c2 in FIG. 10(*b*) and c3 in FIG. 10(*c*)) according to the setting value set by the operation input section 111, is conducted. As the result, when the toner image corresponding to the fixed form size image data is formed on the recording sheet whose size is larger than the fixed form size, and outputted, by using the margin portion of the recording sheet which is finally cut, the check for each page of the plurality of pages at the time of bookbinding can be surely conducted.

(23) In this embodiment, in (20)–(22), when the double side image formation of the recording sheet is conducted, the control of the image formation is conducted so that the image formation areas of the front and rear of the recording sheet coincide with each other such that the cut in 3 directions can be conducted. In this manner, when the image formation is conducted so that the image formation areas of the front and rear of the recording sheet coincide with each other, the image formation area of the front surface of the recording sheet coincides with the patch image position of the rear surface, and when the above check is conducted, the margin portion can be cut in 3 directions of the recording sheet.

(24) In this embodiment, in (23), corresponding to the position set by the operation input section 111, the control by which the patch image is formed in the margin of the recording sheet is independently conducted on each of the front and rear surface of the recording sheets. That is, considering the shape or dimension of the margin portion of the recording sheet, or easiness of the checking of the patch image, or relationship with the image in the image formation area, when the user selects the appropriate position, the telescopic motion of the recording sheet by the fixing, or the slippage of the reading timing is dissolved, and the positions of the patch images are registered on the front and rear, and the check can be surely conducted on each of the front and rear surface of the recording sheet.

(25) In this embodiment, in (20)–(24), after the patch image is formed corresponding to the initially set position, the position resetting image plane for conducting the fine adjustment of the position of the patch image is displayed on the display section 112, and according to the value inputted into the operation input section 111 according to the position resetting image plane, the control means controls so that the patch image is formed in the margin of the recording sheet. That is, considering the shape or dimension of the margin portion of the recording sheet, or easiness of the checking of the patch image, or relationship with the image in the image formation area, when the user resets the appropriate position by referring to the output of the recording sheet, the telescopic motion of the recording sheet by the fixing, or the slippage of the reading timing is dissolved, and the above check can be surely conducted.

Another Embodiment

In this connection, in the description of above embodiment, the position of the patch image by the rectangular marker is changed, and the discrimination for each copy or chapter is conducted, however, in place of the change of the position, the density or shape (letter, figure shape), or the number of the marker may also be changed.

As described above, in the image forming apparatus of the present invention, when the toner image corresponding to the image data of the fixed form size is formed on the recording sheet whose size is larger than the fixed form size, and outputted, the toner image corresponding to the image data of the fixed form size is formed in the area of the fixed form size of the recording sheet, and also in the outside of the area of the fixed form size of the recording sheet (margin portion to be cut), it is made so that the toner image can be formed, and because it is controlled so as to form a predetermined patch image in the margin portion, by using the margin portion of the recording sheet which is finally cut, each kind of check can be conducted.

Disclosed embodiment can be varied by a skilled person without departing from the spirit and scope of the invention.

What is claimed is:

1. An apparatus for forming a toner image on a recording medium, a size of which is larger than that of said toner image being a fixed form size, based on image data corresponding to said fixed form size, said apparatus comprising:

an image-forming section to form said toner image in a region of said fixed form size, based on said image data corresponding to said fixed form size, and to form a specific toner image in a specific region outside said fixed form size, both said region and said specific region being shared each other within a whole area of said recording medium; and a controlling section to control said image-forming section so as to form a predetermined patch image, serving as said specific toner image, in said specific region outside said fixed form size.

2. The apparatus of claim 1, wherein said controlling section controls said image-forming section so that a whole area of said predetermined patch image is contained within said specific region of said recording medium and so that said predetermined patch image is formed at a same position of each of a plurality of recording mediums, each of which is said recording medium.

3. The apparatus of claim 1, wherein said apparatus also has a duplex image forming capability for forming an obverse image and a reverse image on both sides of said recording medium; and wherein said controlling section controls said image-forming section so that an image-forming region of said obverse image coincides with that of said reverse image on both sides of said recording medium in order to cutout said specific region outside said fixed form size at three positions including a top position, a bottom position and a longitudinal position.

4. The apparatus of claim 1, further comprising:

a density detecting sensor to detect a density of said predetermined patch image;

wherein said controlling section controls a density of toner employed for a developing operation, a developing bias voltage and/or a charged voltage employed for a transferring operation, in response to said density of said predetermined patch image detected by said density detecting sensor.

5. The apparatus of claim 1, further comprising:

an operational command inputting device to input an operational command for setting a position of said predetermined patch image;

wherein said controlling section controls said image-forming section so that said predetermined patch image is formed at said position, determined by said operational command inputted from said operational command inputting device, located within said specific region, serving as a margin space of said recording medium.

6. The apparatus of claim 5, wherein said apparatus also has a duplex image forming capability for forming an obverse image and a reverse image on an obverse side and a reverse side of said recording medium, respectively; and wherein said controlling section controls said image-forming section so that said predetermined patch image is independently formed on each of said obverse side and said reverse side of said recording medium.

7. The apparatus of claim 1, further comprising:

an operational command inputting device to input a first operational command for initially setting a position of said predetermined patch image and a second operational command for finely adjusting said position of said predetermined patch image thereafter; and a display device to display a position setting diagram for finely adjusting said position of said predetermined patch image;

wherein said controlling section controls said image-forming section and said display device so that said position setting diagram for finely adjusting said position of said predetermined patch image is displayed on said display device after forming said predetermined patch image at a first position initially determined by said first operational command inputted from said operational command inputting device, and then, said predetermined patch image is formed at a second position finely adjusted by said second operational command inputted from said operational command inputting device based on contents of said position setting diagram.

8. The apparatus of claim 1, wherein, when said apparatus forms toner images on a plurality of recording mediums, which include a plurality of chapters and each of which is said recording medium, said controlling section controls said image-forming section so that said predetermined patch image is formed at a same position on each of recording mediums, which are included in said plurality of recording mediums and constitutes one of said plurality of chapters.

9. The apparatus of claim 8, wherein said controlling section controls said image-forming section so that a position of said predetermined patch image formed on each of said plurality of recording mediums varies with changes of said plurality of chapters.

10. The apparatus of claim 9, further comprising:

an operational command inputting device to input an operational command for setting a position of said predetermined patch image;

wherein said controlling section controls said image-forming section so that said predetermined patch image is formed at said position, determined by said operational command inputted from said operational command inputting device, located within said specific region serving as a margin space of said recording medium.

11. The apparatus of claim 8, wherein said apparatus also has a duplex image forming capability for forming an obverse image and a reverse image on both sides of said recording medium; and wherein said controlling section controls said image-forming section so that an image-forming region of said obverse image coincides with that of said reverse image on both sides of said recording medium in order to cutout said specific region outside said fixed form size at three positions including a top position, a bottom position and a longitudinal position, and so that said predetermined patch image is formed at a position located within said specific region serving as a margin space of said recording medium.

12. The apparatus of claim 10, wherein said apparatus also has a duplex image forming capability for forming an obverse image and a reverse image on an obverse side and a reverse side of said recording medium, respectively; and wherein said controlling section controls said image-forming section so that said predetermined patch image is independently formed on each of said obverse side and said reverse side of said recording medium.

13. The apparatus of claim 8, further comprising:

an operational command inputting device to input a first operational command for initially setting a position of said predetermined patch image and a second operational command for finely adjusting said position of said predetermined patch image thereafter; and a display device to display a position setting diagram for finely adjusting said position of said predetermined patch image;

wherein said controlling section controls said image-forming section and said display device so that said position setting diagram for finely adjusting said position of said predetermined patch image is displayed on said display device after forming said predetermined patch image at a first position initially determined by said first operational command inputted from said operational command inputting device, and then, said predetermined patch image is formed at a second position finely adjusted by said second operational command inputted from said operational command inputting device based on contents of said position setting diagram.

14. The apparatus of claim 1, wherein, when said apparatus produces a plurality of copies, each of which includes a plurality of recording mediums each of which is said recording medium having said toner image formed by said image-forming section, said controlling section controls said image-forming section so that said predetermined patch image is formed at a same position on each of said plurality of recording mediums constituting one of said plurality of copies.

15. The apparatus of claim 14, wherein said controlling section controls said image-forming section so that a position of said predetermined patch image formed on each of said plurality of recording mediums varies with changes of said plurality of copies.

16. The apparatus of claim 15, further comprising:

an operational command inputting device to input an operational command for setting a position of said predetermined patch image;

wherein said controlling section controls said image-forming section so that said predetermined patch image is formed at said position, determined by said operational command inputted from said operational command inputting device, located within said specific region serving as a margin space of said recording medium.

17. The apparatus of claim 14, wherein said apparatus also has a duplex image forming capability for forming an obverse image and a reverse image on both sides of said recording medium; and wherein said controlling section controls said image-forming section so that an image-forming region of said obverse image coincides with that of said reverse image on both sides of said recording medium in order to cutout said specific region outside said fixed form size at three positions including a top position, a bottom position and a longitudinal position, and so that said predetermined patch image is formed at a position located within said specific region serving as a margin space of said recording medium.

18. The apparatus of claim 16, wherein said apparatus also has a duplex image forming capability for forming an obverse image and a reverse image on an obverse side and a reverse side of said recording medium, respectively; and wherein said controlling section controls said image-forming section so that said predetermined patch image is independently formed on each of said obverse side and said reverse side of said recording medium.

19. The apparatus of claim 14, further comprising:

an operational command inputting device to input a first operational command for initially setting a position of said predetermined patch image and a second operational command for finely adjusting said position of said predetermined patch image thereafter; and a display device to display a position setting diagram for finely adjusting said position of said predetermined patch image;

wherein said controlling section controls said image-forming section and said display device so that said position setting diagram for finely adjusting said position of said predetermined patch image is displayed on said display device after forming said predetermined patch image at a first position initially determined by said first operational command inputted from said operational command inputting device, and then, said predetermined patch image is formed at a second position finely adjusted by said second operational command inputted from said operational command inputting device based on contents of said position setting diagram.

20. The apparatus of claim 1, wherein, when said apparatus produces a plurality of copies, each of which includes a plurality of recording mediums each of which is said recording medium having said toner image formed by said image-forming section and onto which a plurality of page numbers are attached one by one, said controlling section controls said image-forming section so that said predetermined patch image is formed at a same position on each of recording mediums having a same page number and included in said plurality of copies.

21. The apparatus of claim 20, wherein said controlling section controls said image-forming section so that a position of said predetermined patch image formed on each of said plurality of recording mediums varies with changes of said plurality of page numbers.

22. The apparatus of claim 21, further comprising:

an operational command inputting device to input an operational command for setting a position of said predetermined patch image;

wherein said controlling section controls said image-forming section so that said predetermined patch image is formed at said position, determined by said operational command inputted from said operational command inputting device, located within said specific region serving as a margin space of said recording medium.

23. The apparatus of claim 20, wherein said apparatus also has a duplex image forming capability for forming an obverse image and a reverse image on both sides of said recording medium; and wherein said controlling section controls said image-forming section so that an image-forming region of said obverse image coincides with that of said reverse image on both sides of said recording medium in order to cutout said specific region outside said fixed form size at three positions including a top position, a bottom position and a longitudinal position, and so that said predetermined patch image is formed at a position located within said specific region serving as a margin space of said recording medium.

24. The apparatus of claim 22, wherein said apparatus also has a duplex image forming capability for forming an obverse image and a reverse image on an obverse side and a reverse side of said recording medium, respectively; and wherein said controlling section controls said image-forming section so that said predetermined patch image is independently formed on each of said obverse side and said reverse side of said recording medium.

25. The apparatus of claim 20, further comprising:

an operational command inputting device to input a first operational command for initially setting a position of said predetermined patch image and a second operational command for finely adjusting said position of said predetermined patch image thereafter; and a display device to display a position setting diagram for finely adjusting said position of said predetermined patch image;

wherein said controlling section controls said image-device forming section and said display device so that said position setting diagram for finely adjusting said position of said predetermined patch image is displayed on said display device after forming said predetermined patch image at a first position initially determined by said first operational command inputted from said operational command inputting device, and then, said predetermined patch image is formed at a second position finely adjusted by said second operational command inputted from said operational command inputting device based on contents of said position setting diagram.

* * * * *